US008882219B2

(12) United States Patent
Sanada

(10) Patent No.: US 8,882,219 B2
(45) Date of Patent: Nov. 11, 2014

(54) INKJET RECORDING APPARATUS AND METHOD

(71) Applicant: FUJIFILM Corporation, Tokyo (JP)

(72) Inventor: Kazuo Sanada, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 112 days.

(21) Appl. No.: 13/631,102

(22) Filed: Sep. 28, 2012

(65) Prior Publication Data

US 2013/0083108 A1 Apr. 4, 2013

(30) Foreign Application Priority Data

Sep. 30, 2011 (JP) ..... 2011-218641

(51) Int. Cl.
*B41J 29/38* (2006.01)
*B41J 19/20* (2006.01)

(52) U.S. Cl.
CPC ..... *B41J 19/20* (2013.01); *B41J 19/205* (2013.01); *B41J 19/202* (2013.01)
USPC ..... 347/10

(58) Field of Classification Search
CPC .. B41J 2/0451; B41J 2/04541; B41J 2/04543; B41J 2/0458; B41J 2/04581; B41J 2/04588; B41J 2/04593; B41J 2/17546; B41J 2/2135; B41J 29/38; B41J 29/393; B41J 2/1752; B41J 19/005; B41J 19/202; B41J 25/304; B41J 25/34
USPC ..... 347/5, 9, 10, 19, 37
See application file for complete search history.

(56) References Cited

U.S. PATENT DOCUMENTS 4,652,159 A 3/1987 Nagai
6,390,588 B1 * 5/2002 Ikeda ..... 347/19
(Continued)

FOREIGN PATENT DOCUMENTS

JP 60-230884 A 11/1985
JP 7-73927 B2 8/1995
(Continued)

OTHER PUBLICATIONS

Japanese Office Action for corresponding Japanese Patent Application No. 2011-218641, dated Aug. 29, 2013, with English translation.

*Primary Examiner* — Manish S Shah
*Assistant Examiner* — Roger W Pisha, II
(74) *Attorney, Agent, or Firm* — Birch, Stewart, Kolasch & Birch, LLP

(57) ABSTRACT

An inkjet recording apparatus includes: an inkjet head which has a nozzle and an ejection energy generating element configured to cause droplets to be ejected from an ejection port of the nozzle; a head movement device which is configured to reciprocally move the inkjet head to scan a recording medium onto which the droplets ejected from the inkjet head are deposited; a linear encoder which is configured to output signals to determine a position of the inkjet head; an ejection trigger signal generating device which is configured to generate ejection trigger signals in accordance with the output signals of the linear encoder, the ejection trigger signals specifying ejection timings of the inkjet head with a temporal resolution of 0.1 μs order; and an ejection control device which is configured to cause the inkjet head to eject the droplets in accordance with the ejection timings specified by the ejection trigger signals.

22 Claims, 18 Drawing Sheets

(56) References Cited

U.S. PATENT DOCUMENTS

| | | | | |
|---|---|---|---|---|
| 6,467,863 | B1 * | 10/2002 | Imanaka et al. | 347/9 |
| 7,384,111 | B2 | 6/2008 | Hosono | |
| 7,887,155 | B2 | 2/2011 | Koike | |
| 2003/0058335 | A1 * | 3/2003 | Tajika et al. | 348/59 |
| 2005/0078134 | A1 * | 4/2005 | Igarashi | 347/14 |
| 2006/0290720 | A1 * | 12/2006 | Katsu | 347/5 |
| 2007/0165073 | A1 * | 7/2007 | Nunokawa | 347/57 |
| 2008/0107435 | A1 * | 5/2008 | Scherdel et al. | 399/66 |
| 2011/0084996 | A1 * | 4/2011 | Hirato et al. | 347/10 |
| 2011/0148961 | A1 * | 6/2011 | Arakawa et al. | 347/9 |

FOREIGN PATENT DOCUMENTS

| | | | |
|---|---|---|---|
| JP | 2003-211767 | A | 7/2003 |
| JP | 2004-209843 | A | 7/2004 |
| JP | 2004-237600 | A | 8/2004 |
| JP | 2004-299348 | A | 10/2004 |
| JP | 2005-41237 | A | 2/2005 |
| JP | 2009-34839 | A | 2/2009 |
| JP | 2009-214326 | A | 9/2009 |

* cited by examiner

FIG.18

| INTERVAL OF PLL OUTPUT TIMING SIGNALS (μs) | CUMULATIVE VALUE (μs) | INTERVAL OF DROPLET EJECTION TIMINGS (μs) | CUMULATIVE VALUE (μs) | DEVIATION OF DROPLET EJECTION TIMING FROM IDEAL TIMING |
|---|---|---|---|---|
| 66 | 66 | 70 | 70 | -6% |
| 66 | 132 | 60 | 130 | 3% |
| 66 | 198 | 70 | 200 | -3% |
| 66 | 264 | 60 | 260 | 6% |
| 66 | 330 | 70 | 330 | 0% |
| 66 | 396 | 70 | 400 | -6% |
| 66 | 462 | 60 | 460 | 3% |
| 66 | 528 | 70 | 530 | -3% |
| 66 | 594 | 60 | 590 | 6% |
| 66 | 660 | 70 | 660 | 0% |
| 66 | 726 | 70 | 730 | -6% |
| 66 | 792 | 60 | 790 | 3% |
| 66 | 858 | 70 | 860 | -3% |

FIG.19

| INTERVAL OF PLL OUTPUT TIMING SIGNALS (μs) | CUMULATIVE VALUE (μs) | INTERVAL OF DROPLET EJECTION TIMINGS (μs) | CUMULATIVE VALUE (μs) | DEVIATION OF DROPLET EJECTION TIMING FROM IDEAL TIMING |
|---|---|---|---|---|
| 66 | 66 | 65 | 65 | 2% |
| 66 | 132 | 65 | 130 | 3% |
| 66 | 198 | 65 | 195 | 5% |
| 66 | 264 | 65 | 260 | 6% |
| 66 | 330 | 65 | 325 | 8% |
| 66 | 396 | 75 | 400 | -6% |
| 66 | 462 | 65 | 465 | -5% |
| 66 | 528 | 65 | 530 | -3% |
| 66 | 594 | 65 | 595 | -2% |
| 66 | 660 | 65 | 660 | 0% |
| 66 | 726 | 65 | 725 | 2% |
| 66 | 792 | 65 | 790 | 3% |
| 66 | 858 | 65 | 855 | 5% |

INKJET RECORDING APPARATUS AND METHOD

BACKGROUND OF THE INVENTION

1. Field of the Invention

The present invention relates to an inkjet recording apparatus and an inkjet recording method, and more particularly to technology for improving image formation quality in an inkjet recording apparatus having a shuttle scanning system which forms an image by performing high-frequency ejection from an inkjet head while reciprocally moving a carriage on which the inkjet head is mounted.

2. Description of the Related Art

In the shuttle scanning inkjet system, it is often that signals specifying droplet ejection timings of an inkjet head (referred to as "ejection trigger signals", "ejection timing signals", "ejection clock signals", etc.) are generated in accordance with positional signals indicating the position of the inkjet head which is obtained from an optical linear encoder arranged along the movement direction of a carriage (main scanning direction) on which the inkjet head is mounted (see Japanese Patent Application Publication Nos. 2009-034839 and 2004-299348, for example).

In general, the linear encoder is constituted of a transparent sheet (scale) in which a pattern of black stripes having a line density in a range of approximately 150 lines per inch (lpi) to 300 lpi is formed, and a light emitting part (including a light-emitting diode (LED), for example) and a light receiving part which are arranged to face each other across the transparent sheet, to detect the shades of the stripes to output signals to be used as the positional signals. It is also possible to arrange two light receiving parts at an interval that is equal to ¼ of the line pitch of the scale so as to obtain two sinusoidal output signals having phases shifted from each other by 90°, which are used to generate the ejection trigger signals achieving the recording resolution that is four times high as the line density in the scale. For example, when the scale in the linear encoder has the line density of 150 lpi, it is possible to generate the ejection trigger signals corresponding to the recording resolution of 600 dots per inch (dpi), by means of the composition in which the two light receiving parts are arranged at positions separated by ¼ of the line pitch of the scale.

If it is necessary to obtain the ejection trigger signals for even higher resolution, then the ejection trigger signals for 1200 dpi, 2400 dpi, or the like, can be generated from the timing signals corresponding to 600 dpi by using a multiplier. The multiplier can include a phase locked loop (PLL) circuit, or can calculate approximate timings by calculation using high-frequency clock signals (see Japanese Patent Application Publication No. 2009-214326, for example).

SUMMARY OF THE INVENTION

The above-described compositions in the related art focus on using the output signals of the linear encoder as the reference signals, and performing droplet ejection at the timings of the reference signals. In the case of the system in the related art which carries out droplet ejection at ejection intervals capable of ensuring a sufficiently long time for settling the meniscus compared to the resonance period of the inkjet head (the intrinsic vibration period of the meniscus) (for example, a system having the head resonance period of 10 μs and capable of ejecting droplets at about 10 kHz (equivalent to the intervals of about 100 μs)), there have been no marked problems in the composition in the related art.

However, in systems which seek to further raise the carriage scanning speed and shorten the ejection intervals (so as to perform high-frequency ejection), with a view to further increasing printing productivity, there are problems in that the image formation quality declines if the ejection trigger signals in the related art is used directly. This is because the effects of the variation (jitter) along the time axis in the ejection trigger signals in the related art give rise to decline in the image quality, which is described in detail later with reference to FIGS. 8 and 9.

The present invention has been contrived in view of these circumstances, an object thereof being to provide an inkjet recording apparatus and an inkjet recording method whereby image formation quality is improved by improving the quality of the ejection trigger signals.

In order to attain the aforementioned object, the present invention is directed to an inkjet recording apparatus, comprising: an inkjet head which has a nozzle and an ejection energy generating element configured to cause droplets to be ejected from an ejection port of the nozzle; a head movement device which is configured to reciprocally move the inkjet head to scan a recording medium onto which the droplets ejected from the inkjet head are deposited; a linear encoder which is configured to output signals to determine a position of the inkjet head moved by the head movement device; an ejection trigger signal generating device which is configured to generate ejection trigger signals in accordance with the output signals of the linear encoder, the ejection trigger signals specifying ejection timings of the inkjet head with a temporal resolution of 0.1 μs order; and an ejection control device which is configured to cause the inkjet head to eject the droplets in accordance with the ejection timings specified by the ejection trigger signals.

According to this aspect of the present invention, when using the output signals of the linear encoder to generate the ejection trigger signals, the temporal resolution of the ejection trigger signals is set to 0.1 μs order, the variation along the time axis in the intervals of the ejection trigger signals is thereby restricted, and the quality of the ejection trigger signals is improved.

When the inkjet head is moved by the head movement device, a signal corresponding to the position of the inkjet head is outputted from the linear encoder in accordance with this movement. An ejection trigger signal (ejection clock signal) which specifies an ejection timing is generated in accordance with this encoder output signal. The temporal resolution of the ejection trigger signals is set to 0.1 μs order, rather than 1 μs order in the related art, and the ejection trigger signals of the intervals adjusted by this temporal resolution of 0.1 μs order are generated and applied to the inkjet head. By this means, the ejection timings are made stable and image formation quality can be improved. By using the ejection trigger signals having the temporal resolution of 0.1 μs order, it is possible to accurately control the droplet ejection timings with errors not more than 1 μs.

In particular, according to this aspect of the present invention, even in cases of performing high-frequency ejection in which the ejection intervals do not reach 10 times the resonance period of the inkjet head, the variation along the time axis of the ejection trigger signals is suppressed to a small amount of variation that does not affect ejection, and good ejection accuracy can be achieved.

Preferably, the ejection trigger signal generating device is configured to generate the ejection trigger signals in which an amount of variation in intervals of the ejection trigger signals adjacent to each other is kept within 0.1 μs order.

According to this aspect of the present invention, the ejection trigger signals applied to the inkjet head are high-quality signals (signals having little variation along the time axis) in which the amount of variation in the intervals of the adjacent ejection trigger signals (the absolute difference of between timings of the adjacent ejection trigger signals) is kept to 0.1 μs order.

Preferably, the ejection trigger signal generating device is configured to generate the ejection trigger signals in which an amount of variation in intervals of the ejection trigger signals adjacent to each other is kept within 0.2 μs.

It is desirable that the circuit of the ejection trigger signal generating device is composed in such a manner that the amount of variation in the intervals of the ejection trigger signals is reduced to not more than 0.2 μs. According to this aspect of the present invention, the amount of variation in the ejection timings (the period difference between the adjacent ejection trigger signals) is very small compared to the resonance period of the inkjet head, and the effects on ejection can be kept small. Furthermore, the variation in the intervals of the adjacent ejection trigger signals is smooth (gradual), and stable ejection is possible.

Preferably, the ejection trigger signal generating device includes: an interval calculating unit which is configured to calculate intervals of timing signals generated in accordance with edge timings of the output signals of the linear encoder; and a moving average processing unit which is configured to calculate a moving average of the intervals of the timing signals calculated by the interval calculating unit.

According to this aspect of the present invention, by carrying out the moving average processing, it is possible to even out variations in the intervals of the timing signals, and the ejection trigger signals having the reduced variation along the time axis can be generated.

Preferably, a number of the timing signals used for calculating the moving average in the moving average processing unit is a multiple of 4.

For example, in a case where phase A encoder signals and phase B encoder signals are obtained from the linear encoder and the timing signals are generated from the rising and falling edges of the phase A encoder signals and the phase B encoder signals, since the intervals of the timing signals tend to vary in units of four consecutive pulses, then it is desirable to take this variation tendency into account and set the number of samples for the moving average processing to a multiple of four.

It is also preferable that a number of the timing signals used for calculating the moving average in the moving average processing unit is a multiple of 2.

For example, in a case where only the phase A encoder signals or only the phase B encoder signals are obtained from the linear encoder and the timing signals are generated from the rising and falling edges of the obtained encoder signals, since the intervals of the timing signals tend to vary in units of two consecutive pulses, then it is desirable to take this variation tendency into account and set the number of samples for the moving average processing to a multiple of two.

It is also preferable that the ejection trigger signal generating device includes: an interval calculating unit which is configured to calculate intervals of timing signals generated in accordance with edge timings of the output signals of the linear encoder; and a low-pass filter processing unit which is configured to carry out digital low-pass filter processing of a sequential calculation type, on values indicating the intervals of the timing signals calculated by the interval calculating unit.

According to this aspect of the present invention, the circuit of the low-pass filter, and the like, is designed so as to achieve a circuit composition that outputs the ejection trigger signals in which the variation in the intervals of the ejection trigger signals is kept to order of 0.1 μs, and desirably not more than 0.2 μs.

Preferably, intervals of the ejection timings of the inkjet head are set such that any difference between consecutive two of the intervals is equal to an integral multiple of a resonance period of the inkjet head.

It is more preferable that the intervals of the timing signals generated in accordance with the output signals of the encoder output are monitored, and the ejection trigger signals are outputted at the intervals which are integral multiples of the head resonance period. In other words, it is preferable that any difference between the intervals of the droplet ejection timings is an integral multiple of the head resonance period. According to this aspect of the present invention, the ejection trigger signals are able to maintain the differences which are the integral multiples of the head resonance period, and it is possible to achieve good droplet ejection in which the variation along the time axis of the ejection trigger signals has virtually no effect on the ejection.

It is also preferable that the inkjet recording apparatus further comprises a trigger signal interval setting unit which is configured to restrict output timings of the ejection trigger signals applied to the inkjet head at intervals of $\alpha$ plus integral multiples of the resonance period of the inkjet head, where $\alpha$ is a constant less than the resonance period of the inkjet head and not less than 0.

According to this aspect of the present invention, in order to cause the difference between the intervals of the droplet ejection timings to be an integral multiple of the head resonance period, it is also possible to adjust the intervals of the droplet ejection timings to a plus the integral multiples of the head resonance period.

Preferably, deviations of deposition positions of the ejected droplets on the recording medium specified by the ejection trigger signals from ideal points on a grid of droplet deposition candidate points specified by a recording resolution are not more than ±10% of an interval of the droplet deposition candidate points.

Provided that the deviations of the actual deposition positions from the ideal deposition points are not more than ±10%, then the deviations are in a tolerable range which does not give rise to problems in practical terms. It is possible to adjust the droplet ejection timings within this tolerable range.

In order to attain the aforementioned object, the present invention is also directed to an inkjet recording method of causing an inkjet head which has a nozzle and an ejection energy generating element configured to cause droplets to be ejected from an ejection port of the nozzle, to deposit the droplets onto a recording medium while reciprocally moving the inkjet head to scan the recording medium, the method comprising: an ejection trigger signal generating step of generating ejection trigger signals in accordance with output signals of a linear encoder configured to determine a position of the inkjet head reciprocally moved, the ejection trigger signals specifying ejection timings of the inkjet head with a temporal resolution of 0.1 μs order; and an ejection control step of causing the inkjet head to eject the droplets in accordance with the ejection timings specified by the ejection trigger signals.

Preferably, an amount of variation in intervals of the ejection trigger signals adjacent to each other is kept within 0.1 μs order, and more preferably within 0.2 μs.

Preferably, the ejection trigger signal generating step includes: an interval calculation step of calculating intervals of timing signals generated in accordance with edge timings of the output signals of the linear encoder; and a moving average processing step of calculating a moving average of the intervals of the timing signals calculated in the interval calculation step.

Preferably, a number of the timing signals used for calculating the moving average in the moving average processing step is a multiple of 4 or a multiple of 2.

It is also preferable that the ejection trigger signal generating step includes: an interval calculation step of calculating intervals of timing signals generated in accordance with edge timings of the output signals of the linear encoder; and a low-pass filter processing step of carrying out digital low-pass filter processing of a sequential calculation type, on values indicating the intervals of the timing signals calculated in the interval calculation step.

Preferably, intervals of the ejection timings of the inkjet head are set such that any difference between consecutive two of the intervals is equal to an integral multiple of a resonance period of the inkjet head.

It is also preferable that the inkjet recording method further comprises a trigger signal interval setting step of restricting output timings of the ejection trigger signals applied to the inkjet head at intervals of $\alpha$ plus integral multiples of the resonance period of the inkjet head, where $\alpha$ is a constant less than the resonance period of the inkjet head and not less than 0.

Preferably, deviations of deposition positions of the ejected droplets on the recording medium specified by the ejection trigger signals from ideal points on a grid of droplet deposition candidate points specified by a recording resolution are not more than ±10% of an interval of the droplet deposition candidate points.

According to the present invention, the variation along the time axis in the ejection trigger signals (ejection clock signals) applied to the inkjet head is reduced, and the image formation quality can be improved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 18 is a chart showing an example of generating the ejection trigger signals at the intervals which are integral multiples of the head resonance period;

FIG. 19 is a chart showing another example of generating the ejection trigger signals at the intervals which are $\alpha$ plus the integral multiples of the head resonance period;

DETAILED DESCRIPTION OF THE PREFERRED EMBODIMENTS

<General Composition of Inkjet Recording Apparatus>

Figure 1:
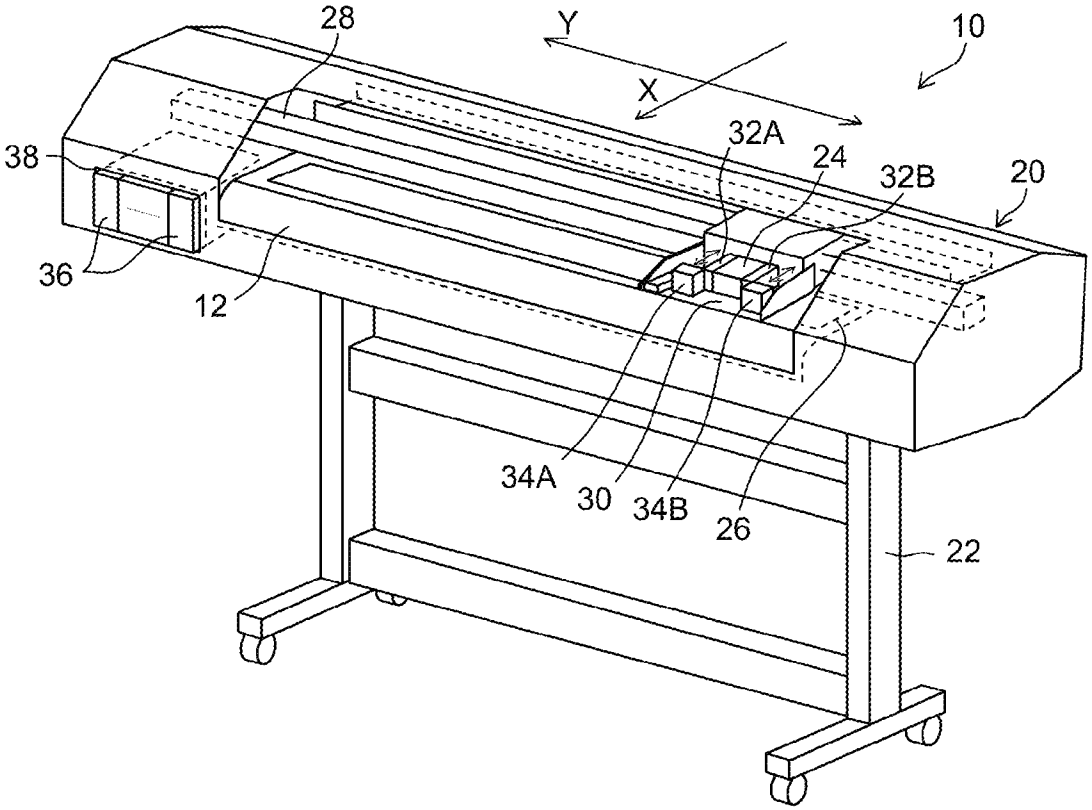
FIG. 1 is a general perspective view of an inkjet recording apparatus according to an embodiment of the present invention.

FIG. 1 is a general perspective view of an inkjet recording apparatus 10 according to an embodiment of the present invention. The inkjet recording apparatus 10 is a wide-format printer which forms a color image on a recording medium 12 by using ultraviolet (UV) curable inks. The wide-format printer is suitable for performing recording in a wide image formation range, such as for large posters or commercial wall advertisements, or the like. Here, a printer corresponding to a medium having a size of A3+(329 mm×483 mm) or greater is referred to as the "wide-format printer".

However, the range of application of the present invention is not limited to the wide format printers. For example, the present invention can also be applied to an inkjet printer which is connected to a personal computer, or the like, and is adaptable to various paper sizes, such as A4 size, B5 size or postcard size, or an inkjet printer adaptable to a paper size such as half Kiku (636 mm×469 mm) or the like. Moreover, there are no particular restrictions on the types of inks used. The inks are not limited to being the UV-curable inks, and it is also possible to use standard aqueous pigment-based inks or dye-based inks, or the like.

The inkjet recording apparatus 10 has a main body 20 and a stand 22, which supports the main body 20. The main body 20 contains: a drop-on-demand type of inkjet head 24 (corresponding to a "recording head"), which ejects and deposits droplets of the inks onto a recording medium 12; a platen 26, which supports the recording medium 12; and a guide mechanism 28 and a carriage 30, which faun a head movement device.

The guide mechanism 28 is disposed so as to extend above the platen 26, along a scanning direction (Y direction) which is parallel to the medium supporting surface of the platen 26 and perpendicular to a conveyance direction of the recording medium 12 (X direction). The carriage 30 is supported so as to be able to reciprocally move along the Y direction on the guide mechanism 28. The inkjet head 24 is mounted on the carriage 30, and provisional curing light sources (pinning light sources) 32A and 32B and main curing light sources (curing light sources) 34A and 34B, which irradiate the ink droplets having been deposited on the recording medium 12 with UV light, are also mounted on the carriage 30.

The provisional curing light sources 32A and 32B are the light sources which irradiate the ink droplets having been deposited on the recording medium 12 by the inkjet head 24 with UV light for provisionally curing the ink droplets to an extent whereby adjacent ink droplets do not combine together. The main curing light sources 34A and 34B are the light sources which additionally irradiate the ink droplets after the provisional curing with UV light for completely curing the ink droplets finally (main curing).

The inkjet head 24, the provisional curing light sources 32A and 32B and the main curing light sources 34A and 34B disposed on the carriage 30 move in unison with (together with) the carriage 30 along the guide mechanism 28. The reciprocal movement direction of the carriage 30 (Y direction) corresponds to the "main scanning direction", and the conveyance direction of the recording medium 12 (X direction) corresponds to the "sub-scanning direction".

The guide mechanism 28 is provided with a linear encoder 70 (shown in FIG. 4) to determine the position of the carriage 30. The ejection timings of the inkjet head 24 are controlled by ejection trigger signals generated in accordance with signals outputted from the linear encoder. The details of an ejection trigger signal generating device according to the present embodiment are described below.

Various media can be used for the recording medium 12, without any restrictions on the material, such as paper, unwoven cloth, polyvinylchloride, compound chemical fibers, polyethylene, polyester, tarpaulin, or the like, or whether the medium is permeable or non-permeable. In the present embodiment, a continuous medium which is prepared in a roll is described, but instead of this it is possible to adopt a mode which uses cut sheets of media (cut paper or the like) which have been cut to a prescribed size.

The recording medium 12 is supplied in a state of roll 42 (shown in FIG. 2) from the back side of the main body 20 in FIG. 1, and after the printing, the recording medium 12 is taken up into a roll 44 (shown in FIG. 2) on the front side of the main body 20. The inkjet head 24 ejects and deposits the ink droplets onto the recording medium 12 being conveyed on the platen 26, and the provisional curing light sources 32A and 32B and the main curing light sources 34A and 34B irradiate the ink droplets having been deposited on the recording medium 12 with UV light.

An installation section 38 for ink cartridges 36 is arranged on the left-hand front side of the main body 20 in FIG. 1. The ink cartridges 36 are replaceable ink supply sources (ink tanks), which store the UV-curable inks. The ink cartridges 36 are prepared correspondingly to the inks of the respective colors which are used in the inkjet recording apparatus 10 of the present embodiment. The ink cartridges 36 of the respective colors are connected to the inkjet head 24 through ink supply channels (not shown) which are independently arranged. The ink cartridges 36 are replaced when the amount of remaining ink of the corresponding color has become low.

Although not shown in the drawings, a maintenance unit for the inkjet head 24 is arranged on the right-hand side of the main body 20 in FIG. 1. The maintenance unit includes a cap for preventing the inkjet head 24 from drying when not printing, and a wiping member (blade, web, etc.) for cleaning the nozzle surface (ink ejection surface) of the inkjet head 24. The cap covering the nozzle surface of the inkjet head 24 is provided with an ink receptacle for receiving ink droplets ejected from the nozzles for the purpose of maintenance.

<Recording Medium Conveyance Path>

Figure 2:
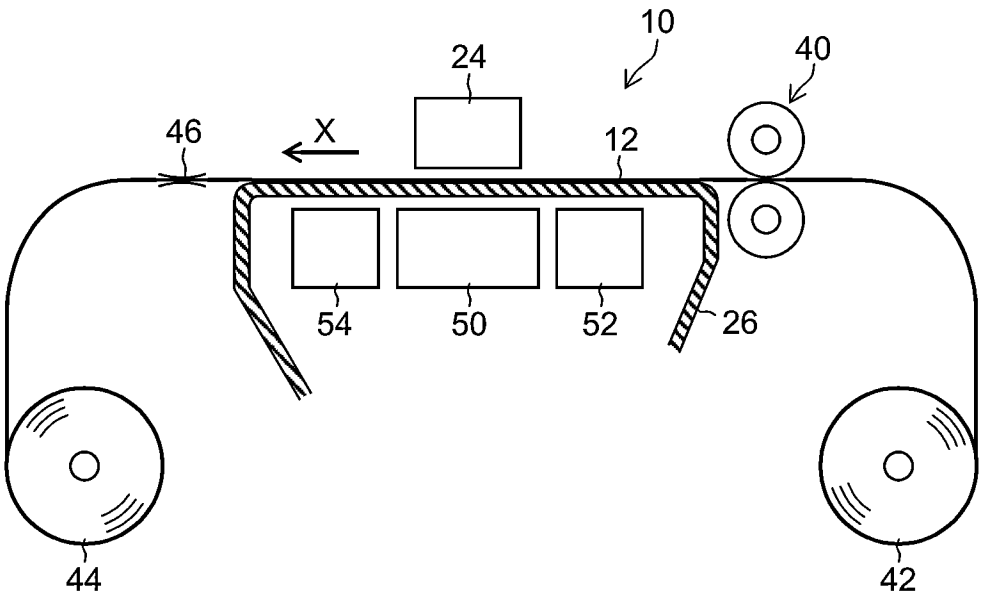
FIG. 2 is an illustrative diagram showing a schematic view of a recording medium conveyance path in the inkjet recording apparatus.

FIG. 2 is a schematic view of the recording medium conveyance path in the inkjet recording apparatus 10. As shown in FIG. 2, the platen 26 is formed in an inverted gutter shape and the upper surface thereof is the medium supporting surface for the recording medium 12. A pair of nip rollers 40 functioning as a recording medium conveyance device for intermittently conveying the recording medium 12 are arranged on the upstream side of the platen 26 in the recording medium conveyance direction (X direction), in the vicinity of the platen 26. The nip rollers 40 move the recording medium 12 in the recording medium conveyance direction over the platen 26.

The recording medium 12 that is unwound from the supply side roll (pay-out supply roll) 42, which constitutes a roll-to-roll medium conveyance system, is intermittently conveyed in the recording medium conveyance direction by the pair of nip rollers 40, which are arranged at an entrance of a print unit (on the upstream side of the platen 26 in terms of the recording medium conveyance direction). When the recording medium 12 has arrived at the print unit directly below the inkjet head 24, printing is carried out by the inkjet head 24, and the recording medium 12 is then wound up into the take-up roll 44 after the printing. A guide 46 for the recording medium 12 is arranged on the downstream side of the print unit in the recording medium conveyance direction.

A temperature adjustment unit 50 for adjusting the temperature of the recording medium 12 during printing is arranged on the rear surface (the surface reverse to the surface supporting the recording medium 12) of the platen 26 at a position opposing the inkjet head 24. The temperature of the recording medium 12 can be adjusted to a prescribed temperature during printing, so that the viscosity, surface tension, and other physical properties, of the ink droplets deposited on the recording medium 12, assume prescribed values and it is possible to obtain a desired dot diameter. According to requirements, the print unit can be provided with a pre-adjustment unit 52 and/or a post-adjustment unit 54 for adjusting the temperature of the recording medium 12 respectively on the upstream side and the downstream side of the temperature adjustment unit 50.

<Inkjet Head>

Figure 3:
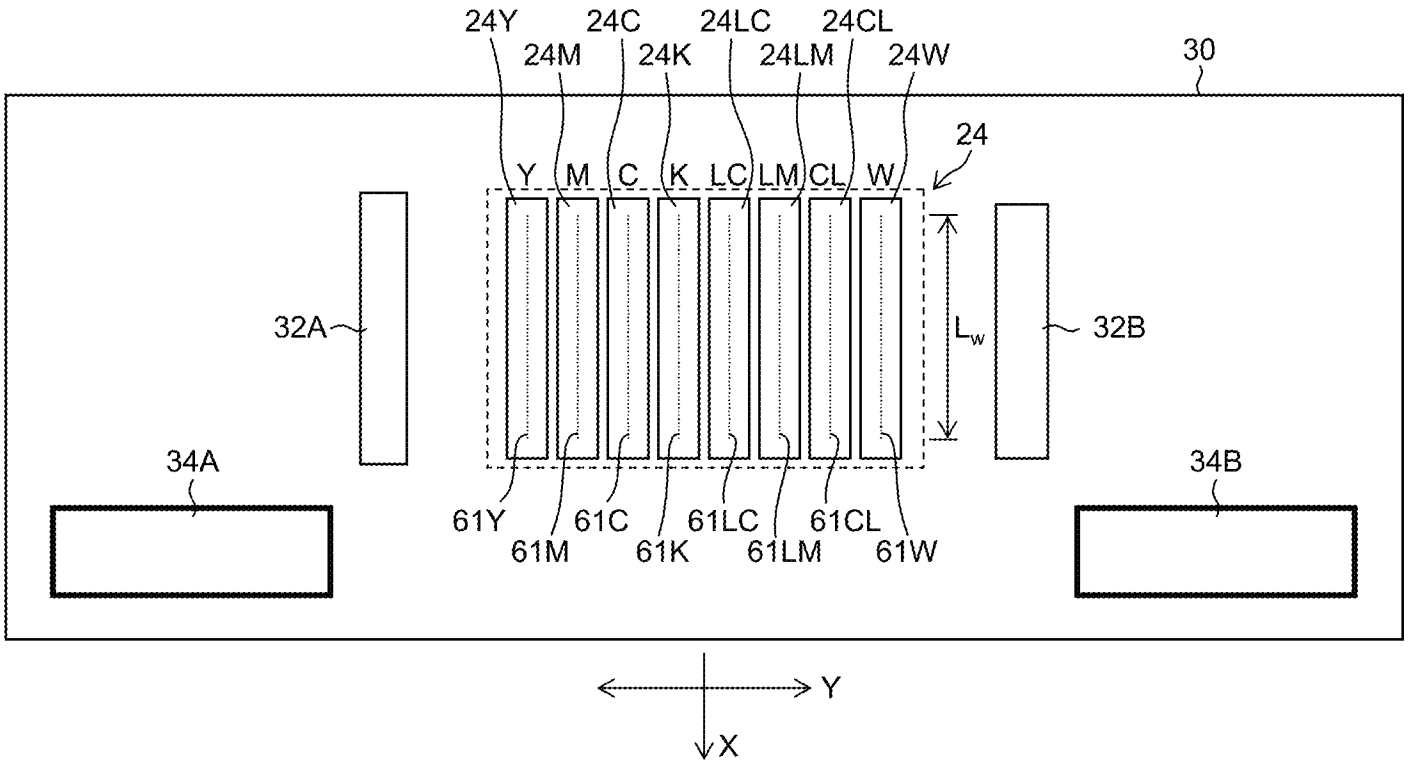
FIG. 3 is a plan perspective diagram showing an example of an arrangement of an inkjet head on a carriage.

FIG. 3 is a plan perspective view showing an example of the arrangement of the inkjet head 24, the provisional curing light sources 32A and 32B and the main curing light sources 34A and 34B, which are arranged on the carriage 30.

The inkjet head 24 has nozzle rows 61Y, 61M, 61C, 61K, 61LC, 61LM, 61CL and 61W for ejecting droplets of the inks of the colors of yellow (Y), magenta (M), cyan (C), black (K), light cyan (LC), light magenta (LM), clear (transparent) (CL) and white (W), respectively. In FIG. 3, the nozzle rows are represented as dotted lines, and individual nozzles are not to depicted. In the following description, the nozzle rows 61Y, 61M, 61C, 61K, 61LC, 61LM, 61CL and 61W may be referred to generally as the nozzle rows 61.

The types of the ink colors (number of colors) and the combination of the ink colors are not limited to the present embodiment. For example, it is also possible to adopt a mode where the LC and LM nozzle rows are omitted, a mode where any of the CL and W nozzle rows are omitted, a mode where a nozzle row for ejecting a metal ink is added, a mode where a nozzle row for ejecting a metal ink is arranged instead of the W nozzle row, or a mode where a nozzle row for ejecting an ink of a special color is added. Moreover, the arrangement sequence of the nozzle rows of the respective colors is not limited in particular. However, a desirable composition is one in which the ink having a low curing sensitivity in response to UV light, of the plurality of ink types, is arranged in close proximity to the provisional curing light source 32A or 32B.

The inkjet head 24 capable of color image formation can be composed by forming head modules for the nozzle rows 61 of the respective colors and arranging the head modules together. For example, it is possible to adopt a mode in which the head modules 24Y, 24M, 24C, 24K, 24LC, 24LM, 24CL and 24W having the nozzle rows 61Y, 61M, 61C, 61K, 61LC, 61LM, 61CL and 61W, respectively, are arranged at regular intervals in the direction of the reciprocal movement of the carriage 30 (the main scanning direction, Y direction). A group of the head modules 24Y, 24M, 24C, 24K, 24LC, 24LM, 24CL and 24W of the respective colors can be interpreted collectedly as one "inkjet head", or the head modules can be interpreted separately as a plurality of "inkjet heads". Alternatively, it is also possible to adopt a mode in which the ink flow channels are divided for the inks of the respective colors inside one inkjet head 24, and the nozzle rows for ejecting the inks of the respective colors are arranged in the one inkjet head 24.

In each of the nozzle rows 61, a plurality of nozzles are arranged in one row (on one straight line) in the direction of conveyance of the recording medium (the sub-scanning direction, X direction) at regular intervals. However, in implementing the present invention, the nozzle arrangement is not limited to any specific arrangement configuration. The nozzles can be arranged in a two dimensional form in two staggered rows or in three or more rows. In the inkjet head 24 according to the present embodiment, the arrangement pitch of the nozzles constituting each nozzle row 61 (nozzle pitch) is 254 μm, which corresponds to the nozzle density of 100 nozzles per inch (npi), the number of the nozzles constituting each nozzle row 61 is 256, and the total length $L_w$ of each nozzle row 61 is approximately 65 mm (254 μm×255=64.8 mm) The ejection frequency (the pixel clock) is 15 kHz, for example, and droplets of volumes of three types, 10 picoliters (pl), 20 pl and 30 pl, can be selectively ejected, by changing the drive waveforms.

The ink ejection method of the inkjet head 24 is a method which ejects a droplet of ink by deformation of a piezoelectric element (piezo jetmethod). For the ejection energy generating element, apart from the piezoelectric element, it is also possible to employ an electrostatic actuator (electrostatic actuator method), and to employ a heater (heating element) which generates bubbles by heating ink to eject a droplet of the ink by the pressure of the bubbles (thermal-jet method). However, since the UV-curable ink generally has a high viscosity compared to solvent ink, it is desirable to employ the piezo jet method which has a relatively large ejection force when using the ultraviolet-curable ink.

<Image Formation Mode>

The inkjet recording apparatus 10 in the present embodiment employs multi-pass image formation control, and the print resolution (recording resolution) can be varied by changing the number of printing passes. For example, three image formation modes are used: high-productivity mode, standard mode and high-quality mode, and the print resolutions are different in the respective modes. It is possible to select the image formation mode in accordance with the print objective and application.

In the high-productivity mode, printing is carried out at the resolution of 600 dpi (in the main scanning direction)×400 dpi (in the sub-scanning direction) on the recording medium 12. In the high-productivity mode, the resolution of 600 dpi is achieved by two passes (two scanning actions) of the inkjet head 24 in the main scanning direction with respect to the recording medium 12. In the first scan (while the outbound movement of the carriage 30), dots are formed on the recording medium 12 at the resolution of 300 dpi. In the second scan (while the inbound movement of the carriage 30), dots are formed on the recording medium 12 at the resolution of 300 dpi so as to be interpolated between the dots having been formed on the recording medium 12 in the first scan (while the outbound movement), and the resolution of 600 dpi is obtained in the main scanning direction.

On the other hand, with respect to the sub-scanning direction, since the nozzle density of the inkjet head 24 is 100 npi in the sub-scanning direction, then one main scanning action (one pass) of the inkjet head 24 with respect to the recording medium 12 can form dots on the recording medium 12 at the resolution of 100 dpi in the sub-scanning direction. Consequently, the resolution of 400 dpi in the sub-scanning direction is achieved by interpolation printing of four passes (four scans) to fill the interspaces between the nozzles. The main scanning speed of the carriage 30 in the high-productivity mode is 1270 mm/s.

In the standard mode, printing is carried out at the resolution of 600 dpi×800 dpi, which is achieved by means of printing of two passes in the main scanning direction and eight passes in the sub-scanning direction.

In the high-quality mode, printing is carried out at the resolution of 1200 dpi×1200 dpi, which is achieved by means of printing of four passes in the main scanning direction and twelve passes in the sub-scanning direction.

While the inkjet head 24 is moving in the main scanning direction (the Y direction in FIG. 1), the nozzles of the inkjet head 24 eject and deposit droplets of the inks onto the recording medium 12. Two-dimensional image formation is carried out on the recording medium 12 by a combination of the reciprocal movement of the inkjet head 24 in the main scanning direction and the intermittent conveyance of the recording medium 12 in the sub-scanning direction (the X direction in FIG. 1).

The ink droplets having been ejected from the nozzles of the inkjet head 24 and deposited on the recording medium 12 are irradiated with UV light for the provisional curing by the provisional curing light source 32A (or 32B) that passes over the ink droplets immediately after the deposition on the recording medium 12. Furthermore, the ink droplets on the recording medium 12 which has passed through the print region of the inkjet head 24 due to the intermittent conveyance of the recording medium 12 are irradiated with UV light for the main curing by the main curing light sources 34A and 34B.

For the light sources of the provisional curing light sources 32A and 32B, it is possible to use UV-LED elements or UV lamps, or the like. The main curing light sources 34A and 34B are not limited to UV-LED elements and can also employ UV lamps, or the like.

It is possible that the provisional curing light sources 32A and 32B are both kept lighting during the printing operation by the inkjet head 24, but it is also possible to extend the lifespan of the light sources by turning off one of the provisional curing light sources 32A and 32B on the front side of the carriage 30 in terms of the movement of the carriage 30 in the main scanning direction. Furthermore, the main curing light sources 34A and 34B are both kept lighting during the printing operation of the inkjet recording apparatus 10. However, in an image formation mode having a slow scanning speed, it is also possible to turn off one of the main curing light sources 34A and 34B. The lighting start timings of the provisional curing light sources 32A and 32B and the main curing light sources 34A and 34B can be simultaneous timings or different timings.

The interval of the droplet deposition points (pixels) which is determined by the recording resolution is referred to as the "droplet deposition point interval", "pixel interval" or "dot interval". The grid (matrix) of the recordable droplet deposition points (droplet deposition candidate points) which is determined by the recording resolution is referred to as the "droplet deposition point grid" or "pixel grid". In the case of the recording resolution of 600 dpi in the main scanning direction by 400 dpi in the sub-scanning direction, the interval of the droplet deposition candidate points in the main scanning direction is 25.4 mm/600≅42.3 μm and the interval of the droplet deposition candidate points in the sub-scanning direction is 25.4 mm/400=63.5 μm. These represent that the size of one cell (corresponding to one pixel) of the droplet deposition point grid is 42.3 μm×63.5 μm. The conveyance of the recording medium and the droplet deposition positions (droplet ejection timings) of the inkjet head 24 are controlled in units of the droplet deposition point intervals determined by the recording resolution. The interval of the droplet deposition points determined by the recording resolution can be referred to as the "resolution pitch" or the "pixel pitch".

<Linear Encoder>

Figure 4:
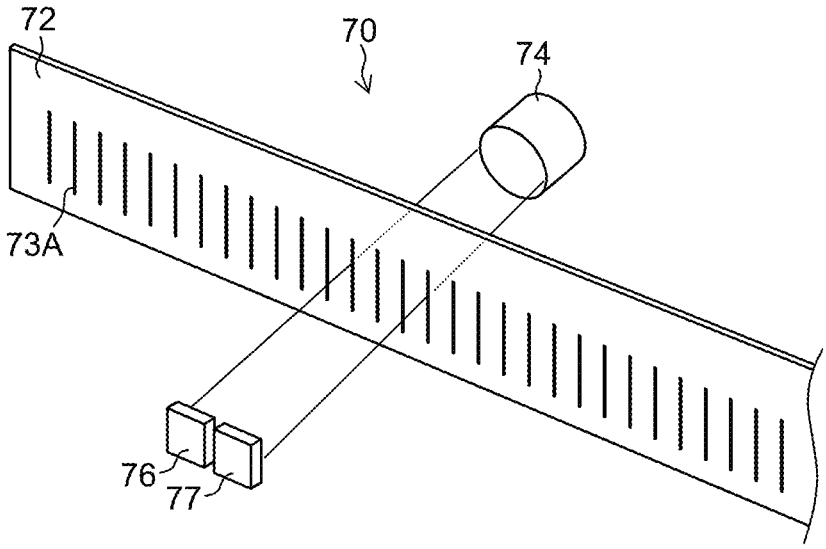
FIG. 4 is a perspective diagram showing a schematic view of a composition of a linear encoder.

Here, the linear encoder 70 which determines the position of the carriage 30 is described. FIG. 4 is a schematic perspective view of the composition of the linear encoder 70. The linear encoder 70 includes: a band-shaped scale 72, which is arranged in parallel with the main scanning direction; a light emitting element 74, and light receiving elements 76 and 77. The scale 72 is made of a light-transmitting (transparent) resin material, and a pattern of black stripes 73A functioning as a light shielding pattern to shield the light is formed at a uniform pitch in the lengthwise direction of the scale 72. For example, the stripes 73A are formed at a line density of 150 lpi.

The light emitting element 74 and each of the light receiving elements 76 and 77 are arranged to face each other across the scale 72, and the light emitted from the light emitting element 74 passes through the scale 72 and is received by the light receiving elements 76 and 77. Each of the light receiving elements 76 and 77 is a photoelectric transducer element, which outputs electrical signals corresponding to the amount of light received. The light receiving elements 76 and 77 are arranged at an interval that corresponds to a phase of 90° (equal to ¼ of the line pitch) with respect to the repetition pitch of the stripes 73A in the scale 72. By means of the thus arranged receiving elements 76 and 77, detection signals of two phases (phase A signals and phase B signals) which are separated from each other by 90° can be obtained.

Figure 5:
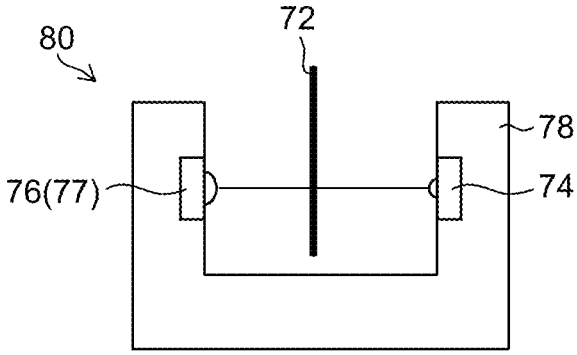
FIG. 5 is a schematic drawing showing an example of a composition of a light emitting unit and a light receiving unit of the linear encoder.

As shown in FIG. 5, the light emitting element 74 and the light receiving elements 76 and 77 are fixed to the inner surfaces of a square U-shaped frame 78 to face each other across the scale 72, thereby constituting a transmissive type photointerrupter 80. The photointerrupter 80 is fixed to the carriage 30, and the scale 72 is fixed to the guide mechanism 28. When the carriage 30 moves along the guide mechanism 28, the photointerrupter 80 also moves with respect to the scale 72, and the light receiving elements 76 and 77 output the light reception signals corresponding to the shadings of the stripes 73A due to the change in the relative positions of the light receiving elements 76 and 77 with respect to the stripes 73A.

Figure 6:
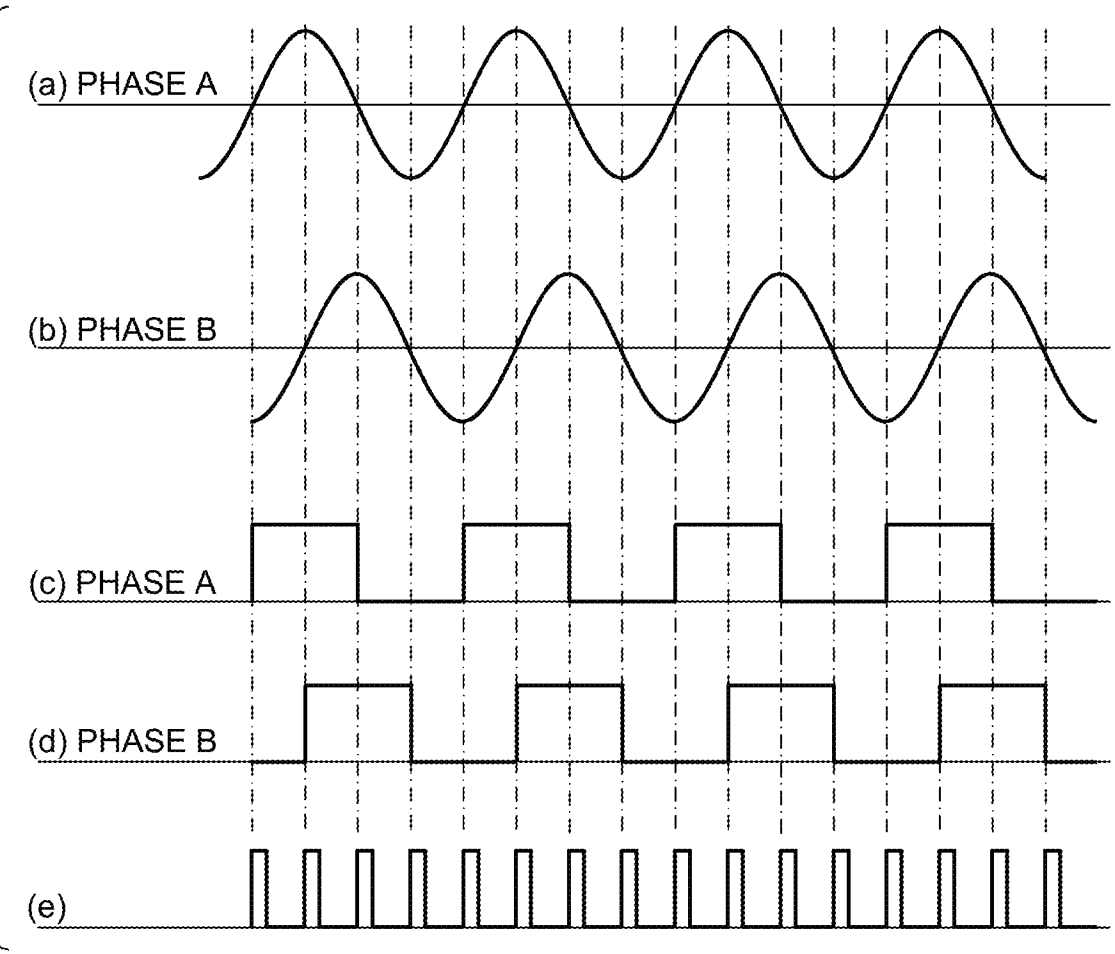
FIG. 6 is an illustrative diagram of output signals of the linear encoder.

FIG. 6 is an illustrative diagram of the output signals of the optical linear encoder. Here, in order to simplify the description, ideal outputs in which there are no errors, such as positional displacement of the scale 72 and variation in the velocity of the carriage 30, are described.

In FIG. 6, a graph (a) shows the phase A original signals (light reception signals), a graph (b) shows the phase B original signals (light reception signals), a graph (c) shows phase A encoder signals obtained by binarizing the phase A original signals, and a graph (d) shows phase B encoder signals obtained by binarizing the phase B original signals.

The signals obtained from the light receiving elements of the optical linear encoder are sinusoidal signals such as those in the graphs (a) and (b) in FIG. 6. By binarizing these sinusoidal signals, the rectangular signals such as those in the graphs (c) and (d) in FIG. 6 are obtained. In FIG. 6, a graph (e) shows timing signals or timing pulses generated at respective timings by detecting the edges (rising edge and falling edge) of the pulses of the phase A encoder signals and the phase B encoder signals.

For example, when the stripes 73A in the scale 72 are arranged at the line density of 150 lpi, it is possible to generate the timing pulses in the graph (e) corresponding to the droplet deposition resolution of 600 dpi, which is equivalent to four times 150 lpi, by detecting the rising edges of the phase A encoder signals, the rising edges of the phase B encoder signals, the falling edges of the phase A encoder signals and the falling edges of the phase B encoder signals.

The thus generated timing pulses in the graph (e) are used as the ejection trigger pulses in the related art; however, there have been the problems described in the "Description of the Related Art".

<Description of Technical Issues>

For example, a system is considered in which the scanning velocity in the main scanning direction of the carriage on which the recording head is mounted is 1.27 m/s, and droplet deposition candidate points are located at the density of 300 dpi in the main scanning direction (i.e., corresponding to the image mode having the recording resolution of 300 dpi in the main scanning direction).

In this case, the ideal ejection trigger signals applied to the recording head are generated at the frequency of 15 kHz (i.e., at the regular intervals of 66.667 μs). However, it is often that the ejection trigger signals are generated by using, as the reference signals, the output signals of the optical encoder arranged on the main scanning axis as described above, and the time intervals of the ejection trigger signals vary due to the velocity fluctuations in the main scanning movement of the carriage and the variation along the time axis in the output signals from the encoder, for instance.

In particular, in the optical encoder, the pulses of the encoder signals are readily shifted from the duty ratio of 50%, depending on how to set the zero point of sinusoidal variation of the original signals corresponding to the amounts of the light received, and therefore the timing signals generated from the encoder signals often show the variation along the time axis at a period of every two times or four times.

Figure 7:
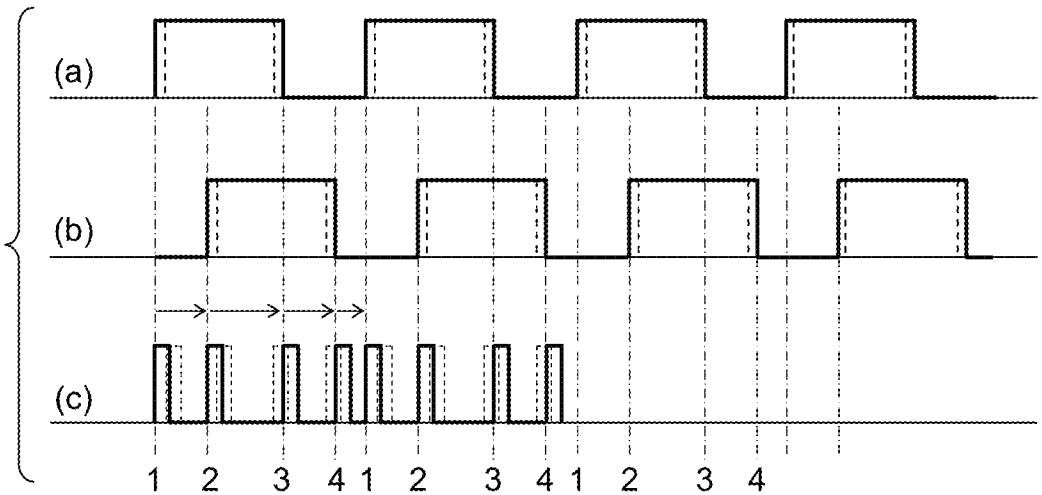
FIG. 7 is an illustrative diagram of phase A encoder signals, phase B encoder signals, and timing signals constituted of pulses generated at edge timings of pulses of the phase A encoder signals and the phase B encoder signals.

The reasons for the above-described variation (jitter) along the time axis in the timing signals are described with reference to FIG. 7. In FIG. 7, a graph (a) shows the phase A encoder signals, a graph (b) shows the phase B encoder signals, and in each of the encoder signals, the duty ratio of the pulses is shifted from 50%. In FIG. 7, a graph (c) shows timing signals or timing pulses generated at respective edge timings of the pulses in the phase A encoder signals and the phase B encoder signals.

As exemplified in the graphs (a) and (b) FIG. 7, in the phase A encoder signals and the phase B encoder signals, the ideal pulses having the duty ratio of 50% are not necessarily obtained, but for various reasons, the pulses having the duty ratio shifted from 50% are obtained. For example, the original encoder signals vary due to various causes, such as variation in the position of the scale 72 inside the photointerrupter 80, distortion of the scale 72, velocity fluctuation in the carriage 30, mechanical vibration during movement of the carriage 30, temporal variation in the photoelectric conversion in the light receiving elements, and so on. Moreover, depending on how to set the zero point when binarizing the original signals, the duty ratio of the pulses in the encoder signals after the binarization can readily deviate from 50% duty.

When the phase A encoder signals and the phase B encoder signals are shifted from the duty ratio of 50% as shown in the graphs (a) and (b) in FIG. 7, the variation can occur in the intervals of the respective timings (and between the corresponding timing pulses in the graph (c)), such as the rise timing of the phase A encoder signal corresponding to the timing pulse 1, the rise timing of the phase B encoder signal corresponding to the timing pulse 2, the fall timing of the phase A encoder signal corresponding to the timing pulse 3, and the fall timing of the phase B encoder signal corresponding to the timing pulse 4.

Consequently, when generating the timing signals corresponding to the recording resolution (dpi) that is four times high as the line density (lpi) of the pattern of stripes in the scale by detecting the edges of the phase A encoder signals and the phase B encoder signals, the intervals of the timing signals are liable to vary with a period of four consecutive timing pulses 1, 2, 3 and 4.

When the timing signals are generated by detecting the rise and fall edges of only the phase A encoder signals or only the phase B encoder signals, the variation along the time axis is liable to appear at a period of two consecutive timing signals.

Figure 8:
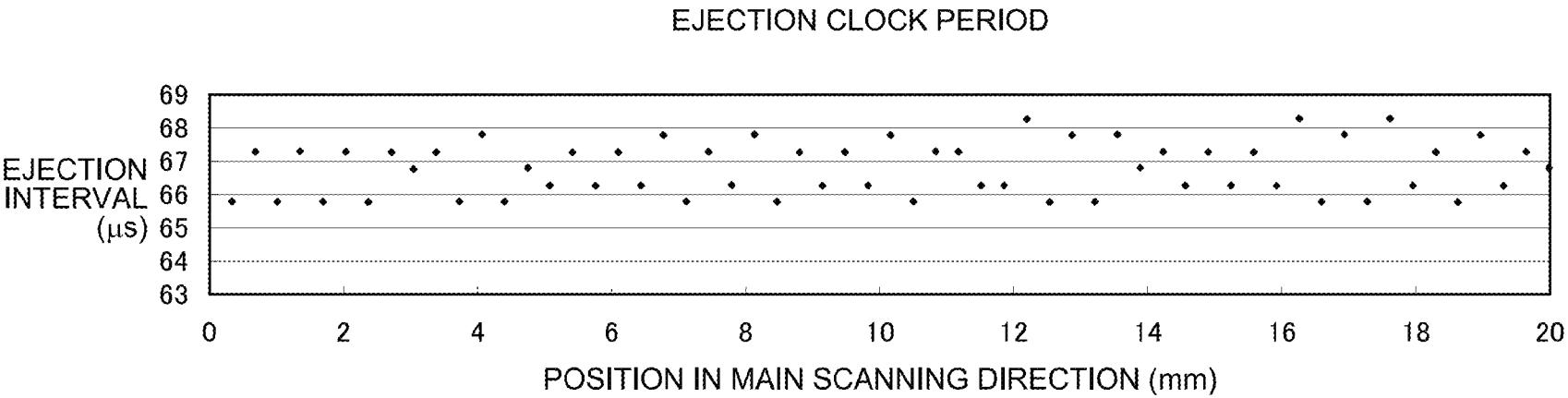
FIG.8 RELATED ART
FIG. 8 is a graph showing an example of variation in the intervals of ejection trigger signals (timing signals generated directly from the encoder signals) in the related art.

FIG. 8 is a graph showing an example of variation in the intervals of the ejection trigger signals (the timing signals generated directly from the encoder signals) in the related art. The horizontal axis represents the position in the main scanning direction (mm), and the vertical axis represents the ejection intervals (μs). As shown in FIG. 8, the intervals of the ejection trigger signals fluctuate with an error of approximately 1 μs alternately with approximately each signal. In other words, the intervals of the ejection trigger pulses vary within 1 μs order.

In the related art, when ejecting droplets at a frequency of about 10 kHz, for instance, it is possible to ensure the ejection time intervals of about 100 μs. In this case, the ejection time intervals are sufficiently longer than the resonance period of the inkjet head (for example, 10 μs), and at any particular ejection timing, variation in the liquid surface (meniscus) in the nozzle caused by the previous ejection has sufficiently settled. In other words, the ejection time interval is ensured whereby a subsequent ejection can be carried out after the vibration of the meniscus due to the previous ejection has sufficiently settled. Consequently, sufficient quality has been achieved in the ejection trigger signals if the ejection trigger signals are created by, for instance, using the encoder output signals directly as the ejection trigger signals, or by interpolating the ejection trigger signals by calculating the time of the 1/n period (where n is any integer larger than 1) of the encoder output signals using a PLL or time counter, or the like.

Figure 9:
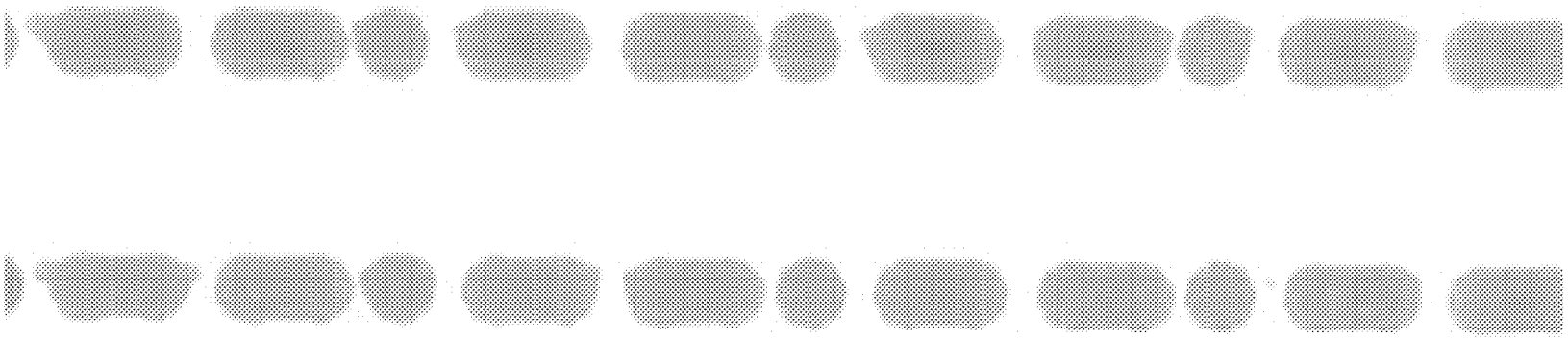
FIG.9 RELATED ART
FIG. 9 is a diagram showing droplet deposition results of droplet ejection using the ejection trigger signals in the related art.

However, in a system which seeks to further improve productivity by the faster main scanning velocity and at the shorter ejection intervals, as in the above-described system having the main scanning velocity of 1.27 m/s and the droplet deposition candidate points located at the density of 300 dpi, or in a system which seeks to eject several droplets within one ejection period (one recording period), if the ejection trigger signals in the related art are directly used, droplet ejection results such as those in FIG. 9 are obtained, in which the deposited droplets affect each other (interfere with each other).

Figure 10:
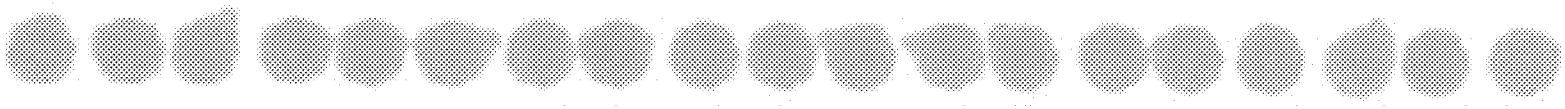
FIG. 10 is a diagram showing desirable droplet deposition results.

FIG. 9 shows the results of carrying out droplet ejection using the ejection trigger signals in the related art (the signals having the variation in the intervals as shown in FIG. 8), in the system having the carriage main scanning velocity of 1.27 m/s and the droplet deposition candidate points located at the density of 300 dpi. FIG. 9 shows two rows of deposited dots formed of the droplets ejected continuously from two nozzles. Ideally, as shown in FIG. 10, it is desirable that the droplets ejected from each nozzle are independent (isolated and separated) on the surface of the recording medium and form dots which are close to circular shapes, but in actual practice, as shown in FIG. 9, it frequently happens that the droplets at adjacent droplet deposition points join together.

As described above, if carrying out high-frequency droplet ejection using the ejection trigger signals in the related art directly, the ejection from the inkjet head is affected by the slight variation along the time axis (the jitter in 1 μs order as illustrated in FIG. 7) in the droplet ejection clock signals (the ejection trigger signals) and the depositing positions of the ejected droplets are not uniformly arranged.

This phenomenon can be described as follows on the basis of the resonance frequency of the inkjet head. When an ejection command is applied to the inkjet head at a timing where the meniscus has not become sufficiently settled after the previous ejection, the application timing of the ejection drive waveform contributes a phase component of the resonance frequency of the inkjet head, which is about 100 kHz (equivalent to the resonance period of about 10 μs). If the variation along the time axis of the ejection trigger signals is 1 μs, then this variation (jitter) of 1 μs along the time axis contributes $2\pi/10$ in terms of the phase of the ejection drive waveform, and therefore has a large effect on the ejection.

As shown in FIG. 8, when viewed in detail (microscopically), the timings of the encoder signals directly used in the related art vary by about 1 μs to 2 μs each time (i.e., vary in 1 μs order). Since the timings of the encoder signals vary along the time axis in this way, then it is not appropriate to specify the droplet ejection timings with reference to the encoder signals. In order to resolve the problems described with reference to FIG. 9 and achieve good ejection, it is desirable to sufficiently suppress the variation along the time axis of the ejection trigger signals.

Therefore, in the present embodiment, the following measures are employed.

(1) The temporal resolution of the ejection trigger signals is set to 0.1 μs order, rather than 1 μs order in the related art.

(2) Moreover, the ejection trigger signals are gradually increased and decreased (changed progressively) while generating the ejection trigger signals with the temporal resolution of 0.1 μs order as described above.

(3) Furthermore, it is desirable that the period of the ejection trigger signals is not varied with respect to the resonance period of the inkjet head, while keeping the variation in the intervals of the ejection trigger signals adjacent to each other sufficiently small. More specifically, a desirable composition is one in which any difference between consecutive two of the intervals of the ejection trigger signals is set to be equal to an integral multiple of the resonance period of the inkjet head.

The resonance period of the inkjet head is the intrinsic period of the whole vibrating system, which is determined by the dimensions, material and physical values of the ink flow channel system, the ink (acoustic element), the piezoelectric element, and so on. In the case of the inkjet head using the piezoelectric elements, the ejection mechanism of each nozzle employs a system in which the piezoelectric element (ejection energy generating element) is arranged on a diaphragm on a pressure chamber which is connected to a nozzle aperture (ejection port), and a pressure variation is applied to the liquid in the pressure chamber by driving the piezoelectric element to displace the diaphragm, whereby a droplet of the liquid is ejected from the nozzle aperture.

When the piezoelectric element is driven to move the diaphragm, the meniscus in the nozzle vibrates at the resonance period due to the pressure variation inside the pressure chamber. The ejection operation produced by the application of the ejection drive waveform is designed in view of the head resonance period.

First Embodiment

Figure 11:
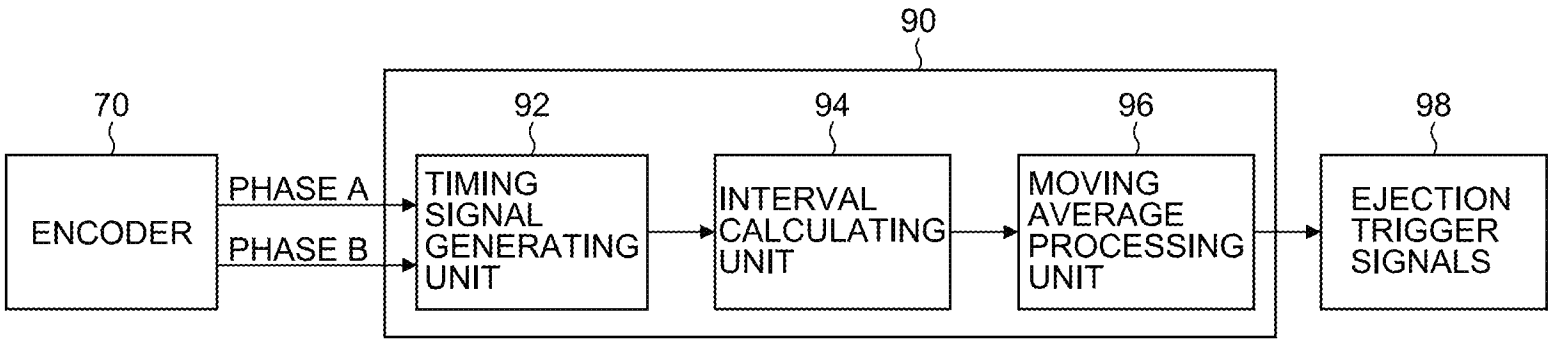
FIG. 11 is a block diagram of an ejection trigger signal generating device according to a first embodiment of the present invention.

FIG. 11 is a block diagram of the ejection trigger signal generating device according to a first embodiment of the present invention.

A signal processing unit 90 generates the ejection trigger signals in accordance with the output signals of the encoder 70. The signal processing unit 90 includes: a timing signal generating unit 92, which generates the timing signals by detecting the edges of the pulses of the phase A encoder signals and the phase B encoder signals obtained from the encoder 70; an interval calculating unit 94, which calculates the intervals of the timing signals generated by the timing signal generating unit 92; and a moving average processing unit 96, which finds a moving average of the intervals of the pulses of the timing signals as ascertained by the interval calculating unit 94, and generates pulses at a period of the moving average.

The signal processing unit 90 can be constituted of software or of a combination of hardware and software.

The interval calculating unit 94 calculates the intervals of the output signals of the timing signal generating unit 92 with a clock of high-frequency (for example, 120 MHz) to calculate the period of the timing signals. The timing signals of which the period has been adjusted by the moving average processing unit 96 are used as the ejection trigger signals (ejection clock signals) 98.

Figure 12:
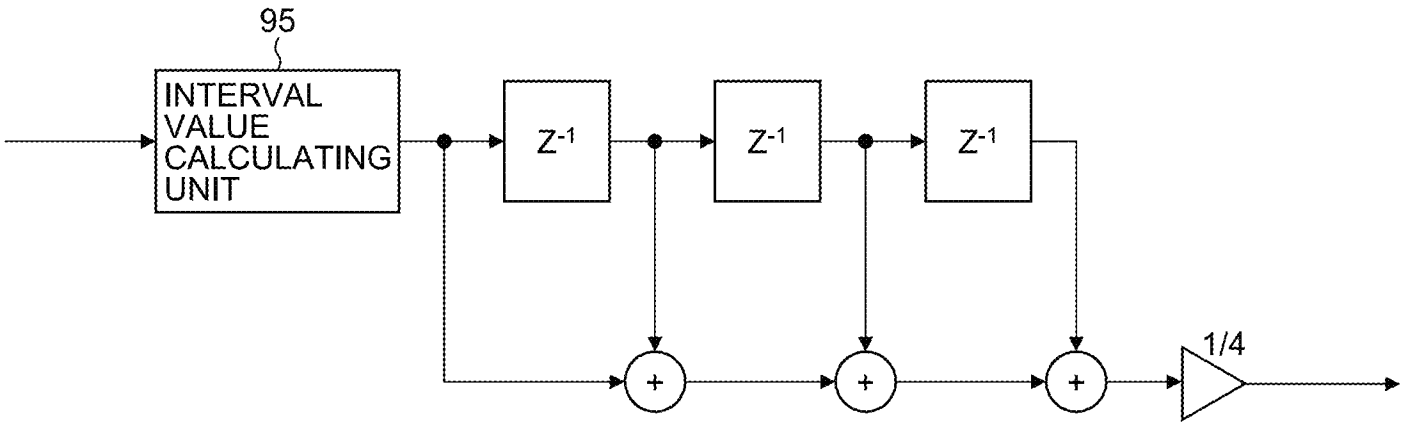
FIG. 12 is a block diagram of a moving average processing unit.

FIG. 12 is a block diagram of the moving average processing unit 96. FIG. 12 shows an example of processing for determining the moving average of four consecutive values (four samples) including the current value. An interval value calculating unit 95 successively calculates values x(n) representing the intervals of the timing signals in accordance with the outputs of the interval calculating unit 94. The moving average of the four samples is calculated for the interval values calculated at the pulses of the timing signals.

"$Z^{-1}$" in FIG. 12 represents that the input is delayed by one sample time period. The cuiTent value x(n) is added to the three values x(n−1), x(n−2) and x(n−3), which are delayed by one sample time period each from the current value, and the summed value is divided by the number of samples, 4 (i.e., multiplied by ¼) to determine the average value.

According to the thus obtained average value, the timing signals having the period of the moving average of the four samples are generated. As described with reference to FIG. 7, the jitter characteristics of the encoder signals are small between the rise and fall of the phase A encoder signal and between the fall and rise of the phase A encoder signal, and are also small between the rise and fall of the phase B encoder signal and between the fall and rise of the phase B encoder signal. The intervals of the timing signals obtained by detecting the rise and fall edges of the phase A encoder signals and the phase B encoder signals (i.e., the four times frequency signals corresponding to the four edges; the timing signals corresponding to the droplet deposition resolution of 600 dpi equivalent to four times 150 lpi) tend to vary along the time axis at a unit of four pulses.

Therefore, in view of the jitter characteristics, it is desirable to set the number of pulses of the timing signals to obtain the moving average to a multiple of four. In the present embodiment, the moving average of 4 consecutive pulses for 600 dpi is found, but the invention is not limited to this, and it is also possible to calculate the moving average for 8 consecutive pulses, 12 consecutive pulses, 16 consecutive pulses, and so on.

By adopting the composition described above, the jitter components in the original timing signals can be reduced and it is possible to obtain the ejection trigger signals having a small variation along the time axis between adjacent pulses.

Instead of the above-described composition where the phase A encoder signals and the phase B encoder signals are obtained, if only the pulse signals corresponding to the droplet deposition resolution of 300 dpi are obtained by detecting the edges of only the phase A encoder signals or only the phase B encoder signals, then it is desirable to set the number of pulses of the timing signals to obtain the moving average to a multiple of 2, and a composition which calculates a moving average of 2 consecutive pulses, 4 consecutive pulses, 8 consecutive pulses, or the like, is adopted.

Figure 13:
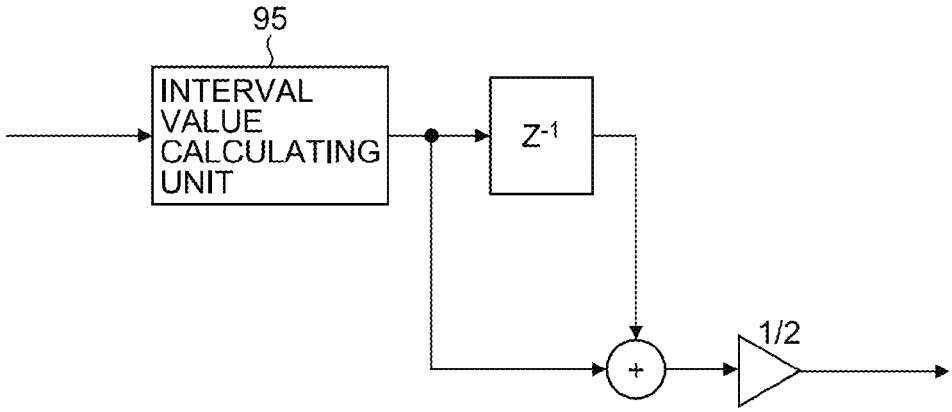
FIG. 13 is a block diagram of a moving average processing unit configured to perform a moving average processing for 2 consecutive pulses.

FIG. 13 is a block diagram of a moving average processing unit configured to perform the moving average processing for 2 consecutive pulses. The details of the processing differ from the composition illustrated in FIG. 12 only in terms of the number of samples, and therefore further description thereof is omitted here.

Figure 14:
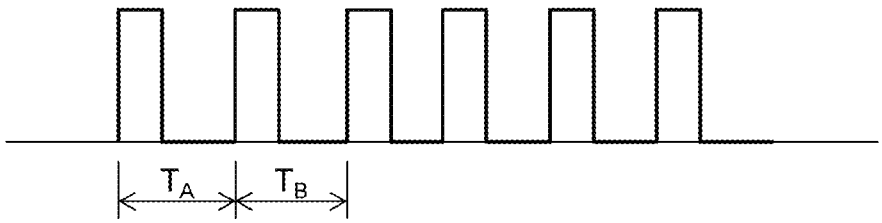
FIG. 14 is a waveform diagram of ejection trigger signals obtained in the first embodiment.

FIG. 14 is a waveform diagram of the ejection trigger signals obtained in the first embodiment. As shown in FIG. 14, the ejection trigger signals obtained in the present embodiment have the reduced encoder jitter components, and the governing factor in the jitter is the mechanical variation in the main scanning action. Thus, in the ejection trigger signals corresponding to the droplet deposition resolution within the range of 300 dpi to 600 dpi, for example, the variation in the intervals of the adjacent trigger signals (adjacent pulses) is kept to be less than 1 μs. The variation in the intervals $T_A$ and $T_B$ of the adjacent ejection trigger signals (the absolute difference $|T_A-T_B|$) is restricted to not more than 0.2 μs.

In the whole range in the main scanning direction, the variation in the intervals of the adjacent ejection trigger signals is kept to 0.1 μs order, and more desirably, kept within 0.2 μs.

Figure 15:
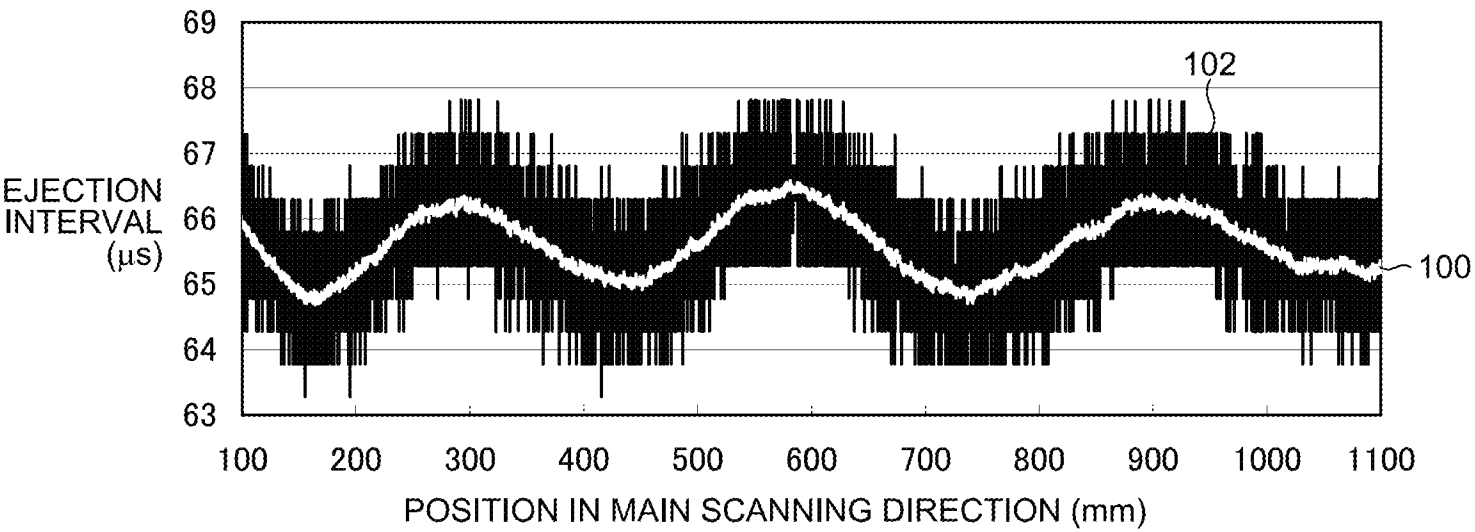
FIG. 15 is a graph showing a comparison between the ejection intervals of the ejection trigger signals obtained in the first embodiment and the ejection intervals of the ejection trigger signals in the related art.

FIG. 15 is a graph showing a comparison between the ejection intervals of the ejection trigger signals obtained in the first embodiment and the ejection intervals of the ejection trigger signals in the related art. The horizontal axis represents the position in the main scanning direction (mm), and the vertical axis represents the ejection intervals (μs). In FIG. 15, the ejection trigger signals according to the first embodiment are represented as a smooth curve and denoted with the reference numeral 100, and the ejection trigger signals in the related art are denoted with the reference numeral 102. The ejection trigger signals 102 in the related art have a large interval variation of about 2 μs between the adjacent ejection trigger signals, and the interval between the adjacent ejection trigger signals varies greatly each time. Furthermore, the ejection trigger signals 102 in the related art vary with an undulation that reflects the mechanical vibration of the main scanning movement when the overall main scanning positions are considered.

On the other hand, as described previously, the interval variation of the ejection trigger signals 100 in the first embodiment is restricted to the variation along the time axis of no more than 0.2 μs between the adjacent ejection trigger signals, and in overall terms, the intervals change smoothly (gradually) within a range of approximately 1 μs around 65.5 μs.

Thus, according to the first embodiment, the temporal resolution of the ejection trigger signals is improved to a quality of 0.1 μs order, and the droplet ejection such as that illustrated in FIG. 10 can be achieved.

Second Embodiment

Next, a second embodiment of the present invention is described.

Figure 16:
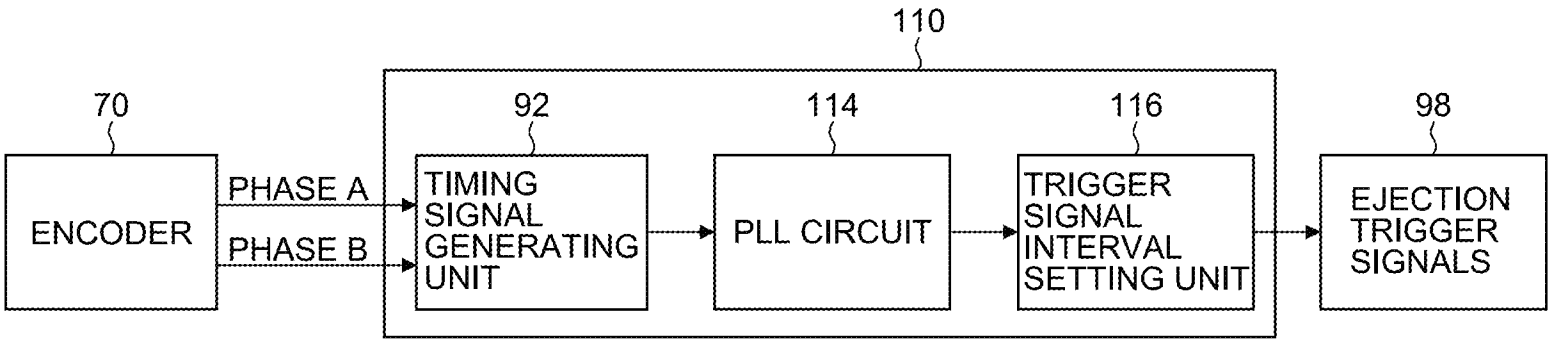
FIG. 16 is a block diagram of an ejection trigger signal generating device according to a second embodiment of the present invention.

FIG. 16 is a block diagram of an ejection trigger signal generating device according to the second embodiment. In FIG. 16, elements which are the same as or similar to those in FIG. 11 are denoted with the same reference numerals and further explanation thereof is omitted here.

The ejection trigger signal generating device in the second embodiment shown in FIG. 16 is provided with a signal processing unit 110, instead of the signal processing unit 90 in the first embodiment shown in FIG. 11. The signal processing unit 110 includes a phase locked loop (PLL) circuit 114 and a trigger signal interval setting unit 116, in order to reduce the variation along the time axis in the timing signals outputted from the timing signal generating unit 92.

Figure 17:
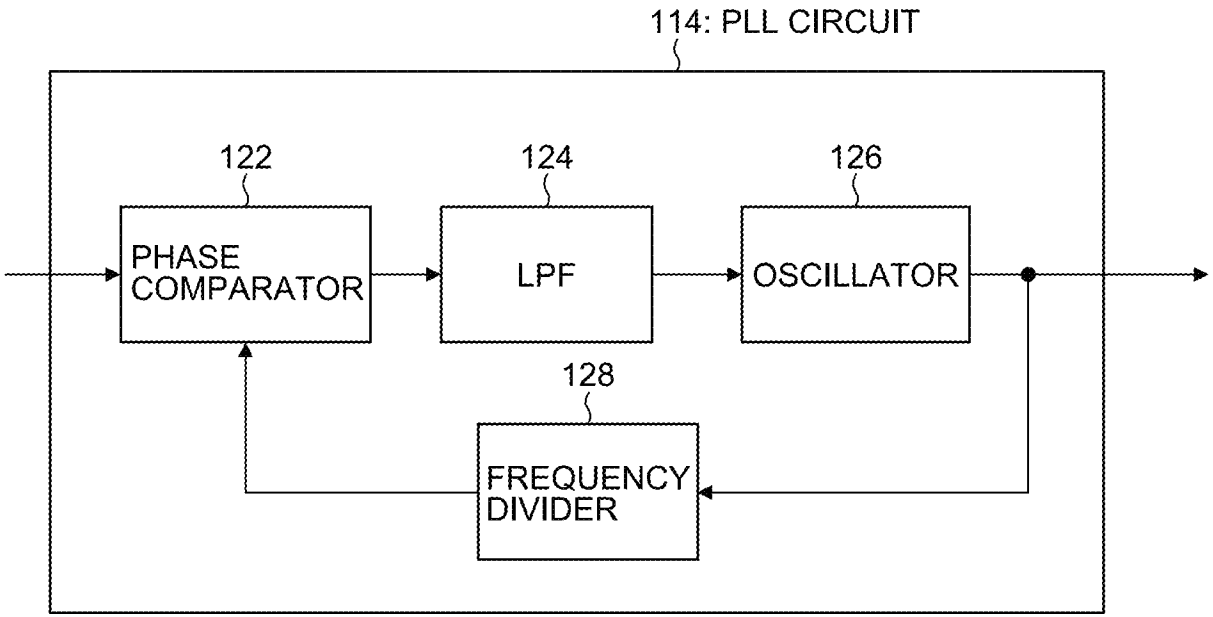
FIG. 17 is a block diagram of a composition of a PLL circuit.

FIG. 17 is a block diagram of a composition of the PLL circuit 114. The PLL circuit 114 includes a phase comparator 122, a low-pass filter (LPF) 124, a voltage-controlled oscillator 126 and a frequency divider 128.

The phase comparator 122 generates a phase difference signal which indicates the phase difference between the timing signals obtained from the timing signal generating unit 92 (see FIG. 16) and feedback signals returned through the frequency divider 128. The LPF 124 is a digital low-pass filter of a sequential calculation type, which converts the phase difference signal into a signal having a voltage value corresponding to the phase difference. When the frequency of the ejection trigger signals (the pixel clock) is 15 kHz, for example, the characteristics of the LPF 124 are set to have a cut-off frequency of approximately 10 kHz, in such a manner that the frequency of 7.5 kHz, which is half of the pixel clock, is cut.

The oscillator 126 generates timing signals having a frequency corresponding to the voltage value indicated by the output signal of the LPF 124.

The frequency divider 128 divides the frequency of the timing signals outputted from the oscillator 126 to generate the feedback signals, which are returned to the phase comparator 122.

The parameters of the PLL circuit 114 are adjusted in such a manner that the timing signals outputted from the PLL circuit 114 (hereinafter referred to as the "PLL output timing signals") are of similar quality to the ejection trigger signals 100 described with reference to FIG. 15. If the design of the PLL circuit 114 enables the PLL output timing signals to have similar quality to the ejection trigger signals in the first embodiment, then it is possible to use the PLL output timing signals directly as the ejection trigger signals.

Here, in order to further improve the characteristics, the above-described measure (3) is taken and the signal processing unit 110 is provided with the trigger signal interval setting unit 116, which generates the ejection trigger signals at intervals which are integral multiples of the head resonance period, from the PLL output timing signals.

The intervals of the ejection trigger signals applied to the inkjet head are set to the integral multiples of the head resonance period, which has been determined previously, and in accordance with the cumulative value of the intervals of the PLL output timing signals (referred to as "timings A") (the cumulative value of the timing count), the timing of the ejection trigger signal (referred to as "timing B") at the next integral multiple value is used. By adopting this composition, the ejection trigger signals can maintain the intervals which are the integral multiples of the head resonance period at all times, and ideal droplet ejection (see FIG. 10) can be achieved.

The trigger signal interval setting unit 116, which functions as the device for selecting the timings of the ejection trigger signals to be applied to the inkjet head, calculates the cumulative value of the intervals of the PLL output timing signals, and generates the ejection trigger signals at the droplet ejection timings having the intervals expressed as "$\alpha$+the integral multiples of the head resonance period" (where $\alpha$ is a constant which is less than the head resonance period and not less than 0). The output of the trigger period setting unit 116 is applied to the inkjet head and is used as the ejection trigger signal.

FIG. 18 is a chart showing an example of generating the ejection trigger signals at the intervals which are the integral multiples of the head resonance period. Here, the period of the timings A is approximately 66 μs, and the head resonance period is 10 μs. As shown in FIG. 18, each of the intervals of the timings B (the droplet ejection timings) is the integral multiple of the head resonance period (10 μs), in contrast to the period of the timings A (approximately 66 μs).

When the PLL output timing signals are at the uniform period (66 μs), the cumulative values of the intervals of the PLL output timing signals are multiples of 66 μs. The actual ejection timings (droplet ejection timings) are set (limited) to the timings at the intervals (here, 70 μs or 60 μs) which are the integral multiples of the head resonance period of 10 μs. The cumulative value of the timing count of the intervals at which the ejection trigger signals are generated is set in such a manner that the next ejection trigger signal is generated at the interval that is the integral multiple of the head resonance period.

Since the ejection trigger signals are outputted only at the intervals which are the integral multiples of the head resonance period, then the error gradually cumulates with respect to the cumulative value of the intervals of the PLL output timing signals. When this error cumulates until reaching the value equivalent to the head resonance period, the integer value of the integral multiple is increased by one in such a manner that the integral multiple relationship of the interval of the ejection trigger signals with respect to the head resonance period is maintained.

The droplet ejection timings corresponding to the cumulative values 70, 130, 200, . . . (μs) shown in the chart in FIG. 18 have the deviations (errors) from the ideal timings to deposit the ejected droplets onto the ideal points on the grid of droplet deposition candidate points within ±6%. In general, if the deviations in the centers of gravity of the deposited droplets from the ideal points on the grid of droplet deposition candidate points are within ±10% of the intervals of the ideal points, then this droplet deposition accuracy is acceptable in practical terms. In other words, it is possible to adjust the droplet ejection timings in units of the head resonance period, provided that droplets which are ejected at the adjusted droplet ejection timings are deposited at positions of which the deviations from the ideal points on the grid of droplet deposition candidate points are kept within ±10% of the intervals of the ideal points. In the example in FIG. 18, it is possible to generate the ejection trigger signals at the intervals which are the integral multiples of the head resonance period, and good droplet ejection can be achieved, while ensuring the droplet deposition accuracy.

In FIG. 18, the intervals of the droplet ejection timings are set to the integral multiples of the head resonance period, but the intervals of the droplet ejection timings can also be set to α plus the integral multiples of the head resonance period. α can be defined as any value which is a constant less than the head resonance period and not less than 0. FIG. 19 shows an example where α is 5 μs.

In the example in FIG. 19, each of the intervals of the droplet ejection timings is set to the sum of 5 μs and the integral multiple of the head resonance period. Even if using this composition, the difference between the two consecutive intervals of the ejection trigger signals can maintain the integral multiple relationship with respect to the head resonance period at all times, and good droplet ejection can be achieved.

Third Embodiment

Figure 20:
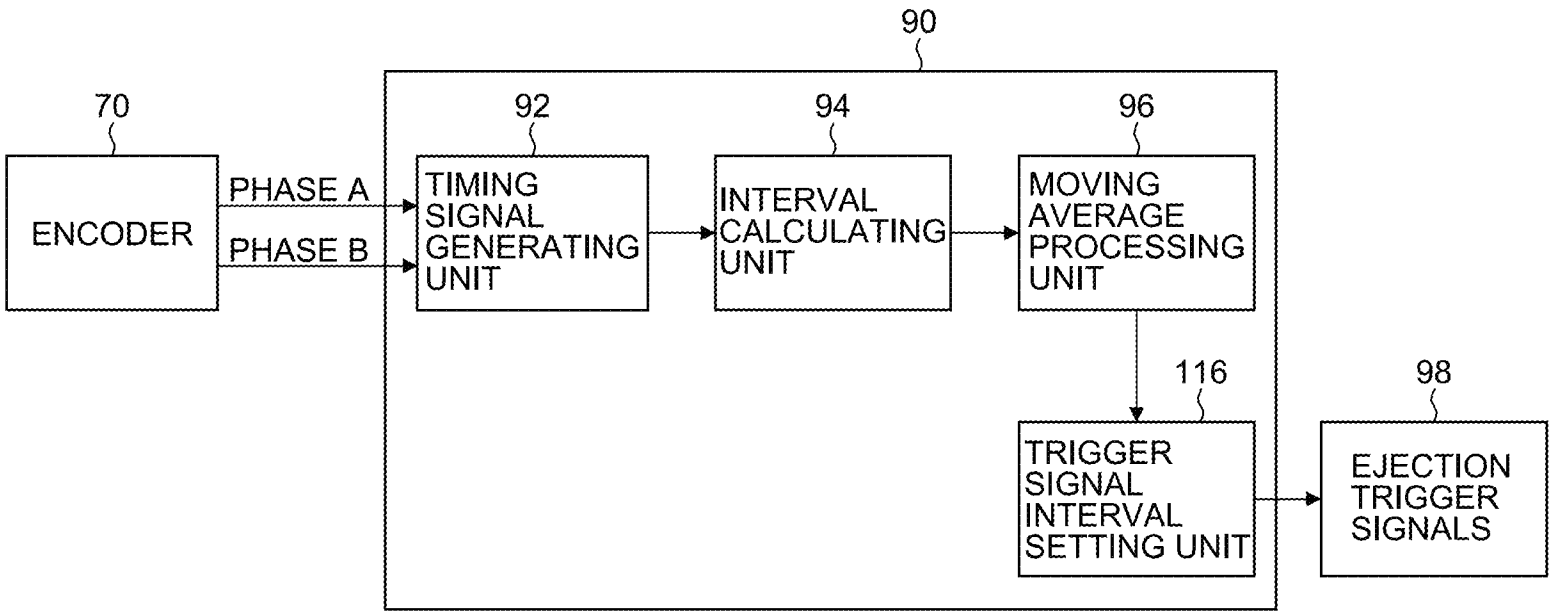
FIG. 20 is a block diagram of an ejection trigger signal generating device according to a third embodiment of the present invention.

It is also possible to adopt a composition which combines the composition of the trigger signal interval setting unit 116 shown in FIGS. 18 and 19 with the first embodiment. FIG. 20 shows a block diagram of this. In FIG. 20, elements which are the same as or similar to those in FIGS. 11 and 16 are denoted with the same reference numerals and further explanation thereof is omitted here.

A desirable composition is one in which the ejection trigger signal generation timings are restricted in such a manner that the intervals of the droplet ejection timings become α plus the integral multiples of the head resonance period, with respect to the timing signals outputted from the moving average processing unit 96. By this means, it is possible to generate the ejection trigger signals at the intervals of which the differences are the integral multiples of the head resonance period, at all times.

<Ejection of a Plurality of Droplets in One Recording Period>

When a plurality of droplets are ejected in one recording period for performing dot recording on one pixel (one droplet deposition candidate point) on a recording medium, the variation along the time axis of the ejection trigger signals has a great effect the ejection. For example, if one recording period is approximately 66 μs, then there are cases where three to four droplets are consecutively ejected within this period of 66 μs, and these droplets are deposited to join together to form a large dot. In this case, it is necessary to eject the three or four droplets within one recording period by using the head resonance period (for example, 10 μs), and therefore the timings are especially important when three or four pulses of the ejection trigger signals are applied to the inkjet head within one recording period.

The time variation of 1 μs order in the ejection trigger signals in the related art greatly affects the ejection and diminishes image formation quality. On the other hand, according to the embodiments of the present invention described above, the quality of the ejection trigger signals is improved and good droplet ejection can be achieved even in cases where a plurality of droplets are ejected within one recording period.

<Control System of Inkjet Recording Apparatus>

Figure 21:
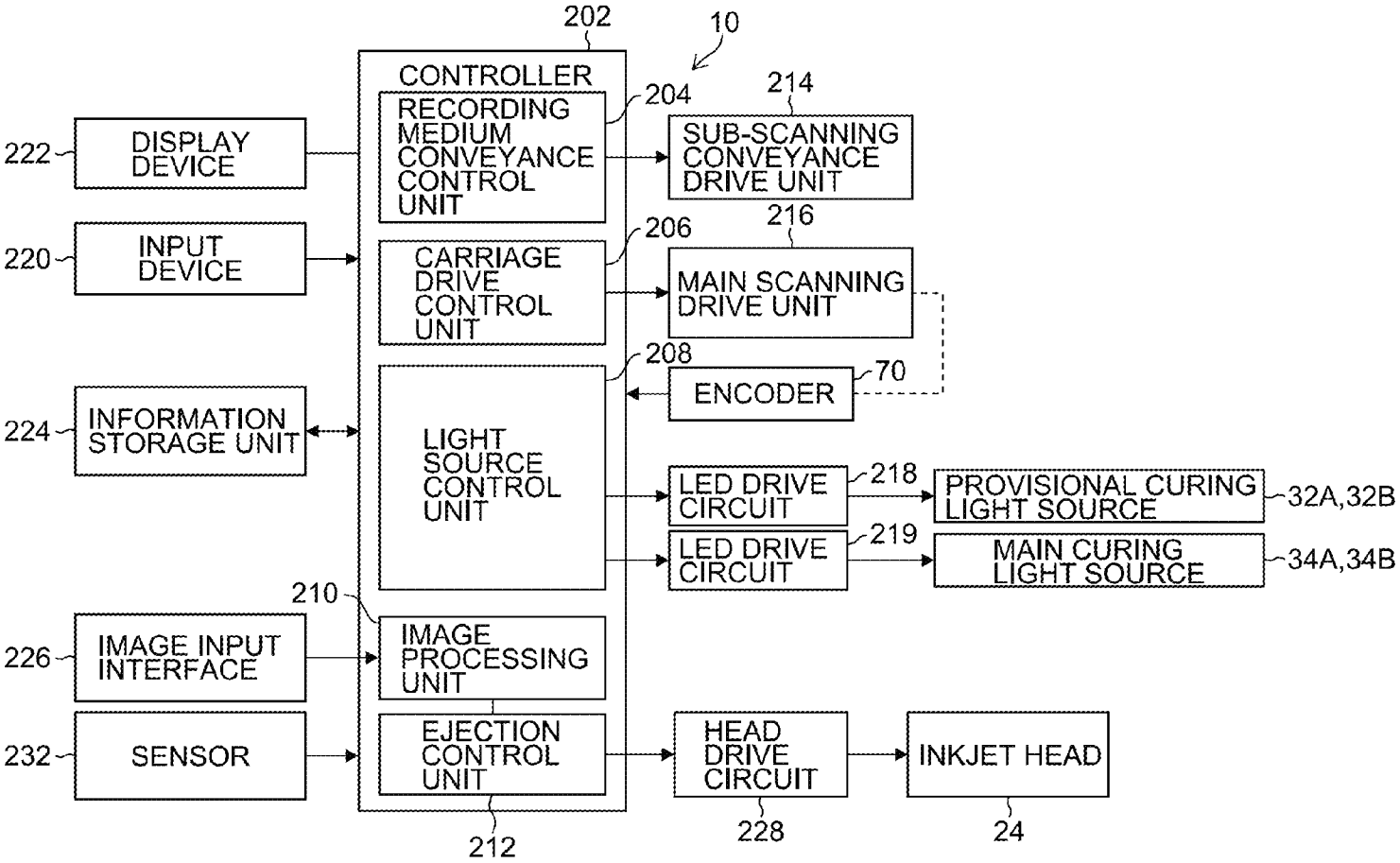
FIG. 21 is a block diagram of a composition of the inkjet recording apparatus.

FIG. 21 is a block diagram of the composition of the inkjet recording apparatus 10 according to the embodiment of the present invention. As shown in FIG. 21, the inkjet recording apparatus 10 is provided with a controller 202. For the controller 202, it is possible to use, for example, a computer equipped with a central processing unit (CPU), or the like. The controller 202 functions as a control device for controlling the whole of the inkjet recording apparatus 10 in accordance with prescribed programs, as well as functioning as a calculation device for performing respective calculations. The controller 202 includes a recording medium conveyance control unit 204, a carriage drive control unit 206, a light source control unit 208, an image processing unit 210, and an ejection control unit 212. Each of these units is achieved by a hardware circuit or software, or a combination of these.

The recording medium conveyance control unit 204 controls a conveyance drive unit 214 for conveying the recording medium 12 (see FIG. 1). The conveyance drive unit 214 includes a drive motor which drives the nip rollers 40 shown in FIG. 2, and a drive circuit thereof. The recording medium 12 which is conveyed on the platen 26 (see FIG. 1) is conveyed intermittently in the sub-scanning direction, in accordance with a reciprocal scanning action (printing pass action) in the main scanning direction preformed by the inkjet head 24.

The carriage drive control unit 206 shown in FIG. 21 controls a main scanning drive unit 216 for moving the carriage 30 (see FIG. 1) in the main scanning direction. The main scanning drive unit 216 includes a drive motor which is connected to a movement mechanism of the carriage 30, and a control circuit thereof. The light source control unit 208 is a control device which controls light emission by the UV-LED elements of the provisional curing light sources 32A and 32B through an LED drive circuit 218, as well as controlling light emission by the UV-LED elements of the main curing light sources 34A and 34B through an LED drive circuit 219.

An input device 220, such as an operating panel, and a display device 222, are connected to the controller 202. The input device 220 is a device by which external operating signals are manually inputted to the controller 202, and can employ various modes, such as a keyboard, a mouse, a touch panel, operating buttons, or the like. The display manually device 222 can employ various modes, such as a liquid crystal display (LCD), an organic electroluminescence (EL) display, a cathode ray tube (CRT), or the like. An operator is able to select an image formation mode (image formation format), input print conditions, and input and edit additional conditions, and the like, by operating the input device 220, and is able to confirm the input details and various information such as search results, through the display on the display device 222.

Furthermore, the inkjet recording apparatus 10 is provided with an information storage unit 224, which stores various information, and an image input interface 226 for acquiring image data for printing. It is possible to employ a serial interface or a parallel interface for the image input interface 226. It is also possible that the image input interface 226 is provided with a buffer memory (not shown) for achieving high-speed communications.

The image data inputted through the image input interface 226 is converted into data for printing (dot data) by the image processing unit 210. In general, the dot data is generated by subjecting the multiple-tone image data to color conversion processing and half-tone processing. The color conversion processing is for converting image data represented by the sRGB system (for example, 8-bit RGB image data of respective colors of RGB) into image data of the respective colors of inks used by the inkjet recording apparatus 10.

The half-toning processing is for converting the color data of the respective colors generated by the color conversion processing into dot data of the respective colors by means of error diffusion, a threshold value matrix, or the like. The method for carrying out the half-toning processing can employ commonly known methods of various kinds, such as an error diffusion method, a dithering method, a threshold value matrix method, a density pattern method, and the like. The half-toning processing generally converts tonal image data having M values ($M \geq 3$) into tonal image data having N values ($N<M$). In the simplest example, the image data is converted into dot image data having 2 values (dot on/off), but in a half-toning process, it is also possible to perform quantization in multiple values which correspond to different types of dot sizes (for example, three types of dots: a large dot, a medium dot and a small dot).

The binary or multiple-value image data (dot data) obtained in this way is used for "driving (on)" or "not driving (off)" the respective nozzles, or in the case of multiple-value data, is also used as ink ejection data (droplet control data) for controlling the ejected droplet volumes (dot sizes).

The ejection control unit 212 generates ejection control signals for a head drive circuit 228 in accordance with the dot data generated in the image processing unit 210. Furthermore, the ejection control unit 212 includes a drive waveform generation unit (not shown). The drive waveform generation unit is a device which generates a drive voltage signal for driving the ejection energy generation elements (in the present embodiment, the piezoelectric elements) which correspond to the respective nozzles of the inkjet head 24. The waveform data of the drive voltage signal is previously stored in the information storage unit 224 and waveform data to be used is outputted as and when required. The signal (drive waveform) outputted from the drive waveform generation unit is supplied to the head drive circuit 228. The signal outputted from the drive waveform generation unit can be digital waveform data or an analog voltage signal.

A common drive voltage signal is applied to the ejection energy generation devices of the inkjet head 24 though the head drive circuit 228 while switching elements (not shown) connected to the individual electrodes of the energy generating elements are turned on and off in accordance with the ejection timings of the respective nozzles, droplets of the ink are ejected from the corresponding nozzles.

Programs to be executed by the CPU of the system controller 202 and various data required for control purposes are stored in the information storage unit 224. The information storage unit 224 stores resolution settings information corresponding to the image formation mode, the number of passes (number of scanning repetitions), conveyance amount information necessary for controlling the conveyance of the recording medium in the sub-scanning direction, and control information for the provisional curing light sources 32A and 32B and the main curing light sources 34A and 34B, and the like.

As described with reference to FIG. 4, the encoder 70 is installed on the main scanning movement mechanism, and the encoder signal is outputted in accordance with the movement of the carriage 30. The encoder signal is sent to the controller 202. The controller 202 functions as a device which generates the ejection trigger signal from the output signal of the encoder 70.

Furthermore, although not illustrated, an encoder is installed on the drive motor of the conveyance drive unit 214. This encoder outputs an encoder signal corresponding to the amount of rotation and the speed of rotation of the drive motor of the conveyance drive unit 214. This encoder signal of the conveyance system is sent to the controller 202, and the position of the recording medium 12 (see FIG. 1) is ascertained in accordance with this signal.

A sensor 232 is installed on the carriage 30, and the width of the recording medium 12 is ascertained in accordance with a sensor signal obtained from the sensor 232.

The ejection control unit 212 in the present embodiment corresponds to a "droplet ejection control device".

<Recording Medium>

The "recording medium" is a general term for a medium on which droplets ejected from the inkjet head are deposited, and this includes various terms, such as printed medium, recorded medium, image forming medium, image receiving medium, ejection receiving medium, print medium, and the like. In implementing the present invention, there are no particular restrictions on the material or shape, or other features, of the recording medium, and it is possible to employ various different media, irrespective of their material or shape, such as continuous paper, cut paper, seal paper, OHP sheets or other resin sheets, film, cloth, nonwoven cloth, a substrate for printed circuits on which a wiring pattern, or the like, is formed, or a rubber sheet.

MODIFICATION EXAMPLE 1

In the embodiments described above, the provisional curing light sources 32A and 32B and the main curing light sources 34A and 34B are arranged symmetrically with respect to the inkjet head 24 in the main scanning direction (arranged in linear symmetry with respect to a central line), and the droplet ejection and the UV irradiation are carried out by reciprocal scanning (two-way scanning), but it is also possible to adopt a mode in which the provisional curing light source and the main curing light source are arranged only on one side of the inkjet head 24 and image formation is carried out by one-way scanning.

Furthermore, in implementing the present invention, it is not absolutely necessary to use the ultraviolet-curable ink. More specifically, it is also possible to adopt a mode which uses normal ink and omits the composition of the provisional curing light sources 32A and 32B and the main curing light sources 34A and 34B.

MODIFICATION EXAMPLE 2

Sub-Scanning Movement

In the inkjet recording apparatus 10 in FIG. 1, the example in which the recording medium 12 is conveyed in the sub-scanning direction is described, but the mode in which the inkjet head and the recording medium are moved relatively to each other in the sub-scanning direction is not limited to this example. For instance, it is also possible to adopt a mode which moves the inkjet head in the sub-scanning direction while the recording medium is stationary, or a mode which achieves the sub-scanning movement by combining movement of the inkjet head and the conveyance of the recording medium.

<The Relationship Between the Main Scanning Direction and the Sub-Scanning Direction>

As shown in FIG. 1, it is desirable from a control viewpoint, that the main scanning direction and the sub-scanning direction are perpendicular to each other. In implementing the invention, the main scanning direction and the sub-scanning direction do not necessarily have to be in a strictly perpendicular relationship. In order to achieve two-dimensional image formation, the main scanning direction and the sub-scanning direction should be mutually intersecting (should not be parallel).

<Examples of Application of Apparatus>

In the embodiments described above, the drop-on-demand wide-format inkjet recording apparatus has been described by way of an example, but the scope of application of the present invention is not limited to this. The invention can also be applied to inkjet recording apparatuses other than the wide format recording apparatus. Furthermore, the present invention is not limited to a graphic printing application, and can also be applied to various image forming apparatuses, which are capable of forming various types of image patterns, such as a wire pattern forming apparatus which forms an image of a wiring pattern on an electronic circuit substrate, a manufacturing apparatus for various devices, a resist printing apparatus using resin liquid as a functional liquid for ejection (which corresponds to an "ink"), a fine structure forming apparatus, or the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

an inkjet head which has a nozzle and an ejection energy generating element configured to cause droplets to be ejected from an ejection port of the nozzle;

a head movement device which is configured to reciprocally move the inkjet head to scan a recording medium onto which the droplets ejected from the inkjet head are deposited;

a linear encoder which is configured to output signals to determine a position of the inkjet head moved by the head movement device;

an ejection trigger signal generating device which is configured to generate ejection trigger signals in accordance with the output signals of the linear encoder, the ejection trigger signals specifying ejection timings of the inkjet head with a temporal resolution of 0.1 μs order; and an ejection control device which is configured to cause the inkjet head to eject the droplets in accordance with the ejection timings specified by the ejection trigger signals, wherein the ejection trigger signal generating device includes:

an interval calculating unit which is configured to calculate intervals of timing signals generated in accordance with edge timings of the output signals of the linear encoder; and a low-pass filter processing unit which is configured to carry out digital low-pass filter processing of a sequential calculation type, on values indicating the intervals of the timing signals calculated by the interval calculating unit.

2. The inkjet recording apparatus as defined in claim 1, wherein the ejection trigger signal generating device is configured to generate the ejection trigger signals in which an amount of variation in intervals of the ejection trigger signals adjacent to each other is kept within 0.1 μs order.

3. The inkjet recording apparatus as defined in claim 1, wherein the ejection trigger signal generating device is configured to generate the ejection trigger signals in which an amount of variation in intervals of the ejection trigger signals adjacent to each other is kept within 0.2 μs.

4. The inkjet recording apparatus as defined in claim 1, wherein the ejection trigger signal generating device includes:

an interval calculating unit which is configured to calculate intervals of timing signals generated in accordance with edge timings of the output signals of the linear encoder; and a moving average processing unit which is configured to calculate a moving average of the intervals of the timing signals calculated by the interval calculating unit.

5. The inkjet recording apparatus as defined in claim 4, wherein a number of the timing signals used for calculating the moving average in the moving average processing unit is a multiple of 4.

6. The inkjet recording apparatus as defined in claim 4, wherein a number of the timing signals used for calculating the moving average in the moving average processing unit is a multiple of 2.

7. The inkjet recording apparatus as defined in claim 1, wherein intervals of the ejection timings of the inkjet head are set such that any difference between consecutive two of the intervals is equal to an integral multiple of a resonance period of the inkjet head.

8. An inkjet recording apparatus, comprising:

an inkjet head which has a nozzle and an ejection energy generating element configured to cause droplets to be ejected from an ejection port of the nozzle;

a head movement device which is configured to reciprocally move the inkjet head to scan a recording medium onto which the droplets ejected from the inkjet head are deposited;

a linear encoder which is configured to output signals to determine a position of the inkjet head moved by the head movement device;

an ejection trigger signal generating device which is configured to generate ejection trigger signals in accordance with the output signals of the linear encoder, the ejection trigger signals specifying ejection timings of the inkjet head with a temporal resolution of 0.1 μs order; and an ejection control device which is configured to cause the inkjet head to eject the droplets in accordance with the ejection timings specified by the ejection trigger signals, wherein:

intervals of the ejection timings of the inkjet head are set such that any difference between consecutive two of the intervals is equal to an integral multiple of a resonance period of the inkjet head; and deviations of deposition positions of the ejected droplets on the recording medium specified by the ejection trigger signals from ideal points on a grid of droplet deposition candidate points specified by a recording resolution are not more than ±10% of an interval of the droplet deposition candidate points.

9. The inkjet recording apparatus as defined in claim 8, wherein the ejection trigger signal generating device includes:

an interval calculating unit which is configured to calculate intervals of timing signals generated in accordance with edge timings of the output signals of the linear encoder; and a moving average processing unit which is configured to calculate a moving average of the intervals of the timing signals calculated by the interval calculating unit.

10. An inkjet recording apparatus, comprising:

an inkjet head which has a nozzle and an ejection energy generating element configured to cause droplets to be ejected from an ejection port of the nozzle;

a head movement device which is configured to reciprocally move the inkjet head to scan a recording medium onto which the droplets ejected from the inkjet head are deposited;

a linear encoder which is configured to output signals to determine a position of the inkjet head moved by the head movement device;

an ejection trigger signal generating device which is configured to generate ejection trigger signals in accordance with the output signals of the linear encoder, the ejection trigger signals specifying ejection timings of the inkjet head with a temporal resolution of 0.1 μs order; and an ejection control device which is configured to cause the inkjet head to eject the droplets in accordance with the ejection timings specified by the ejection trigger signals, wherein:

intervals of the ejection timings of the inkjet head are set such that any difference between consecutive two of the intervals is equal to an integral multiple of a resonance period of the inkjet head; and the inkjet recording apparatus further comprises a trigger signal interval setting unit which is configured to restrict output timings of the ejection trigger signals applied to the inkjet head at intervals of a plus integral multiples of the resonance period of the inkjet head, where $\alpha$ is a constant less than the resonance period of the inkjet head and not less than 0.

11. The inkjet recording apparatus as defined in claim 10, wherein deviations of deposition positions of the ejected droplets on the recording medium specified by the ejection trigger signals from ideal points on a grid of droplet deposition candidate points specified by a recording resolution are not more than ±10% of an interval of the droplet deposition candidate points.

12. The inkjet recording apparatus as defined in claim 10, wherein the ejection trigger signal generating device includes:

an interval calculating unit which is configured to calculate intervals of timing signals generated in accordance with edge timings of the output signals of the linear encoder; and a moving average processing unit which is configured to calculate a moving average of the intervals of the timing signals calculated by the interval calculating unit.

13. An inkjet recording method of causing an inkjet head which has a nozzle and an ejection energy generating element configured to cause droplets to be ejected from an ejection port of the nozzle, to deposit the droplets onto a recording medium while reciprocally moving the inkjet head to scan the recording medium, the method comprising:

an ejection trigger signal generating step of generating ejection trigger signals in accordance with output signals of a linear encoder configured to determine a position of the inkjet head reciprocally moved, the ejection trigger signals specifying ejection timings of the inkjet head with a temporal resolution of 0.1 μs order; and an ejection control step of causing the inkjet head to eject the droplets in accordance with the ejection timings specified by the ejection trigger signals, wherein the ejection trigger signal generating step includes:

an interval calculating step of calculating intervals of timing signals generated in accordance with edge timings of the output signals of the linear encoder; and a low-pass filter processing step of carrying out digital low-pass filter processing of a sequential calculation type, on values indicating the intervals of the timing signals calculated in the interval calculating step.

14. The inkjet recording method as defined in claim 13, wherein an amount of variation in intervals of the ejection trigger signals adjacent to each other is kept within 0.1 μs order.

15. The inkjet recording method as defined in claim 13, wherein an amount of variation in intervals of the ejection trigger signals adjacent to each other is kept within 0.2 μs.

16. The inkjet recording method as defined in claim 13, wherein the ejection trigger signal generating step includes:

an interval calculating step of calculating intervals of timing signals generated in accordance with edge timings of the output signals of the linear encoder; and a moving average processing step of calculating a moving average of the intervals of the timing signals calculated in the interval calculating step.

17. The inkjet recording method as defined in claim 13, wherein intervals of the ejection timings of the inkjet head are set such that any difference between consecutive two of the intervals is equal to an integral multiple of a resonance period of the inkjet head.

18. An inkjet recording method of causing an inkjet head which has a nozzle and an ejection energy generating element configured to cause droplets to be ejected from an ejection port of the nozzle, to deposit the droplets onto a recording medium while reciprocally moving the inkjet head to scan the recording medium, the method comprising:

an ejection trigger signal generating step of generating ejection trigger signals in accordance with output signals of a linear encoder configured to determine a position of the inkjet head reciprocally moved, the ejection trigger signals specifying ejection timings of the inkjet head with a temporal resolution of 0.1 μs order; and an ejection control step of causing the inkjet head to eject the droplets in accordance with the ejection timings specified by the ejection trigger signals, wherein:

intervals of the ejection timings of the inkjet head are set such that any difference between consecutive two of the intervals is equal to an integral multiple of a resonance period of the inkjet head; and deviations of deposition positions of the ejected droplets on the recording medium specified by the ejection trigger signals from ideal points on a grid of droplet deposition candidate points specified by a recording resolution are not more than ±10% of an interval of the droplet deposition candidate points.

19. The inkjet recording method as defined in claim 18, wherein the ejection trigger signal generating step includes:

an interval calculating step of calculating intervals of timing signals generated in accordance with edge timings of the output signals of the linear encoder; and a moving average processing step of calculating a moving average of the intervals of the timing signals calculated in the interval calculating step.

20. An inkjet recording method of causing an inkjet head which has a nozzle and an ejection energy generating element configured to cause droplets to be ejected from an ejection port of the nozzle, to deposit the droplets onto a recording medium while reciprocally moving the inkjet head to scan the recording medium, the method comprising:

an ejection trigger signal generating step of generating ejection trigger signals in accordance with output signals of a linear encoder configured to determine a position of the inkjet head reciprocally moved, the ejection trigger signals specifying ejection timings of the inkjet head with a temporal resolution of 0.1 μs order; and an ejection control step of causing the inkjet head to eject the droplets in accordance with the ejection timings specified by the ejection trigger signals, wherein:

intervals of the ejection timings of the inkjet head are set such that any difference between consecutive two of the intervals is equal to an integral multiple of a resonance period of the inkjet head; and the method further comprises a trigger signal interval setting step of restricting output timings of the ejection trigger signals applied to the inkjet head at intervals of a plus integral multiples of the resonance period of the inkjet head, where $\alpha$ is a constant less than the resonance period of the inkjet head and not less than 0.

21. The inkjet recording method as defined in claim 20, wherein deviations of deposition positions of the ejected droplets on the recording medium specified by the ejection trigger signals from ideal points on a grid of droplet deposition candidate points specified by a recording resolution are not more than ±10% of an interval of the droplet deposition candidate points.

22. The inkjet recording method as defined in claim 20, wherein the ejection trigger signal generating step includes:

an interval calculating step of calculating intervals of timing signals generated in accordance with edge timings of the output signals of the linear encoder; and a moving average processing step of calculating a moving average of the intervals of the timing signals calculated in the interval calculating step.

* * * * *